US011366402B2

(12) United States Patent
Ishiduka et al.

(10) Patent No.: US 11,366,402 B2
(45) Date of Patent: Jun. 21, 2022

(54) PROCESS CARTRIDGE AND ELECTROPHOTOGRAPHIC APPARATUS USING THE SAME

(71) Applicant: CANON KABUSHIKI KAISHA, Tokyo (JP)

(72) Inventors: Yuka Ishiduka, Shizuoka (JP); Tsutomu Nishida, Shizuoka (JP); Hideharu Shimozawa, Shizuoka (JP); Nobuhiro Nakamura, Shizuoka (JP); Hiroyuki Watanabe, Shizuoka (JP); Kenichi Kaku, Suntou-gun (JP); Kazuhiro Yamauchi, Suntou-gun (JP); Yuichi Kikuchi, Suntou-gun (JP); Kazuhisa Shida, Kawasaki (JP); Atsushi Okuda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 97 days.

(21) Appl. No.: 17/070,054

(22) Filed: Oct. 14, 2020

(65) Prior Publication Data

US 2021/0116833 A1 Apr. 22, 2021

(30) Foreign Application Priority Data

Oct. 18, 2019 (JP) ..... JP2019-191569

(51) Int. Cl.

*G03G 15/02* (2006.01)
*G03G 15/16* (2006.01)
*G03G 5/047* (2006.01)

(52) U.S. Cl.

CPC ..... *G03G 15/0233* (2013.01); *G03G 5/047* (2013.01); *G03G 15/1685* (2013.01); *G03G 2215/0861* (2013.01); *G03G 2221/183* (2013.01)

(58) Field of Classification Search

CPC ..... G03G 5/147; G03G 5/14713; G03G 15/0233; G03G 15/1685

See application file for complete search history.

(56) References Cited

U.S. PATENT DOCUMENTS

| | | | |
|---|---|---|---|
| 6,697,587 | B2 | 2/2004 | Harada |
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 3/2006 | Tanaka et al. |
| 7,585,604 | B2 | 9/2009 | Ogaki et al. |

(Continued)

FOREIGN PATENT DOCUMENTS

| | | | | |
|---|---|---|---|---|
| JP | 2002003651 A | | 1/2002 | |
| JP | 2006-030456 | * | 2/2006 | ..... G03G 15/08 |

(Continued)

OTHER PUBLICATIONS

Translation of JP 2006-030456.*

(Continued)

*Primary Examiner* — Peter L Vajda
(74) *Attorney, Agent, or Firm* — Venable LLP

(57) ABSTRACT

There is provided a process cartridge detachably attachable to a main body of an electrophotographic apparatus, the process cartridge including an electrophotographic photosensitive member and a charging member, wherein an outer surface of the charging member is composed of at least a matrix and at least a part of domains, a volume resistivity of the matrix is $1.0\times10^5$ times or more of a volume resistivity of the domain, an average value Sd of circle equivalent diameters of the domains observed on the outer surface of the charging member is in a predetermined range, the electrophotographic photosensitive member contains a support, a photosensitive layer, and a protective layer in this order and when a surface roughness of the protective layer is measured, each of a protruding valley portion Rvk, a load length ratio Mr2, and Sd/Rvk is in a predetermined range.

12 Claims, 2 Drawing Sheets

(56) References Cited

U.S. PATENT DOCUMENTS

| | | | |
|---|---|---|---|
| 7,645,547 | B2 | 1/2010 | Okuda et al. |
| 7,655,370 | B2 | 2/2010 | Kitamura et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 8,298,670 | B2 | 10/2012 | Muranaka et al. |
| 8,449,975 | B2 | 5/2013 | Hirakoso et al. |
| 8,455,170 | B2 | 6/2013 | Nakamura et al. |
| 8,481,236 | B2 | 7/2013 | Tanaka et al. |
| 8,628,854 | B2 | 1/2014 | Yamauchi et al. |
| 8,632,935 | B2 | 1/2014 | Sugiyama et al. |
| 8,668,987 | B2 | 3/2014 | Yamauchi et al. |
| 8,669,027 | B2 | 3/2014 | Anezaki et al. |
| 8,715,830 | B2 | 5/2014 | Yamada et al. |
| 8,753,789 | B2 | 6/2014 | Ogaki et al. |
| 8,765,335 | B2 | 7/2014 | Tanaka et al. |
| 8,771,818 | B2 | 7/2014 | Nishioka et al. |
| 8,783,209 | B2 | 7/2014 | Kaku et al. |
| 8,815,479 | B2 | 8/2014 | Shida et al. |
| 8,846,281 | B2 | 9/2014 | Okuda et al. |
| 8,852,743 | B2 | 10/2014 | Kikuchi et al. |
| 8,865,381 | B2 | 10/2014 | Tanaka et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,023,465 | B2 | 5/2015 | Yamada et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,086,643 | B2 | 7/2015 | Kikuchi et al. |
| 9,114,565 | B2 | 8/2015 | Kawai et al. |
| 9,128,403 | B2 | 9/2015 | Yamauchi et al. |
| 9,146,482 | B2 | 9/2015 | Watanabe et al. |
| 9,164,406 | B2 | 10/2015 | Nishi et al. |
| 9,170,506 | B2 | 10/2015 | Tanaka et al. |
| 9,170,507 | B2 | 10/2015 | Sugiyama et al. |
| 9,188,888 | B2 | 11/2015 | Okuda et al. |
| 9,207,550 | B2 | 12/2015 | Okuda et al. |
| 9,256,145 | B2 | 2/2016 | Fujii et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,416 | B2 | 4/2016 | Noguchi et al. |
| 9,341,964 | B2 | 5/2016 | Ogaki et al. |
| 9,360,789 | B1 | 6/2016 | Masu et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,436,106 | B2 | 9/2016 | Kuno et al. |
| 9,436,107 | B2 | 9/2016 | Murakami et al. |
| 9,442,408 | B2 | 9/2016 | Yamauchi et al. |
| 9,442,451 | B2 | 9/2016 | Yamauchi et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,563,139 | B2 | 2/2017 | Kawahara et al. |
| 9,575,422 | B2 | 2/2017 | Okuda et al. |
| 9,581,931 | B2 | 2/2017 | Yamada et al. |
| 9,599,913 | B2 | 3/2017 | Nishioka et al. |
| 9,599,915 | B2 | 3/2017 | Anezaki et al. |
| 9,599,917 | B2 | 3/2017 | Okuda et al. |
| 9,639,009 | B2 | 5/2017 | Yamaguchi et al. |
| 9,645,515 | B2 | 5/2017 | Kuno et al. |
| 9,645,516 | B2 | 5/2017 | Kawahara et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,684,277 | B2 | 6/2017 | Yamamoto et al. |
| 9,726,992 | B2 | 8/2017 | Sakuma et al. |
| 9,740,133 | B2 | 8/2017 | Yamauchi et al. |
| 9,772,596 | B2 | 9/2017 | Mitsui et al. |
| 9,791,792 | B2 | 10/2017 | Miyauchi et al. |
| 9,811,009 | B2 | 11/2017 | Yamada et al. |
| 9,811,021 | B2 | 11/2017 | Muranaka et al. |
| 9,869,032 | B2 | 1/2018 | Kawahara et al. |
| 9,897,931 | B2 | 2/2018 | Nishioka et al. |
| 9,958,802 | B2 | 5/2018 | Kikuchi et al. |
| 9,964,914 | B2 | 5/2018 | Arimura et al. |
| 9,977,353 | B2 | 5/2018 | Nishioka et al. |
| 10,018,927 | B2 | 7/2018 | Yamada et al. |
| 10,018,934 | B2 | 7/2018 | Yamada et al. |
| 10,073,362 | B2 | 9/2018 | Fujii et al. |
| 10,108,129 | B2 | 10/2018 | Yamaguchi et al. |
| 10,162,278 | B2 | 12/2018 | Kuno et al. |
| 10,203,617 | B2 | 2/2019 | Kuno et al. |
| 10,280,148 | B2 | 5/2019 | Nishioka et al. |
| 10,303,085 | B2 | 5/2019 | Sato et al. |
| 10,372,050 | B2 | 8/2019 | Nishi et al. |
| 10,416,581 | B2 | 9/2019 | Ito et al. |
| 10,416,588 | B2 | 9/2019 | Masu et al. |
| 10,539,892 | B2 | 1/2020 | Nishida et al. |
| 10,558,132 | B2 | 2/2020 | Ishiduka et al. |
| 10,558,133 | B2 | 2/2020 | Nakamura et al. |
| 10,642,177 | B2 | 5/2020 | Nakamura et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 10,691,033 | B2 | 6/2020 | Nishida et al. |
| 10,747,130 | B2 | 8/2020 | Okuda et al. |
| 10,747,131 | B2 | 8/2020 | Watanabe et al. |
| 10,838,315 | B2 | 11/2020 | Shimozawa et al. |
| 2005/0208402 | A1 | 9/2005 | Tanaka et al. |
| 2012/0308261 | A1 | 12/2012 | Tsuru et al. |
| 2013/0281276 | A1 | 10/2013 | Watanabe et al. |
| 2013/0310239 | A1* | 11/2013 | Terada ..... G03G 21/1853 428/521 |
| 2014/0004450 | A1 | 1/2014 | Tokimitsu et al. |
| 2014/0093281 | A1 | 4/2014 | Takahashi et al. |
| 2015/0185630 | A1 | 7/2015 | Ito et al. |
| 2015/0185634 | A1 | 7/2015 | Sekiya et al. |
| 2015/0316863 | A1 | 11/2015 | Tanaka et al. |
| 2015/0331346 | A1 | 11/2015 | Yamauchi et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2017/0060008 | A1 | 3/2017 | Okuda et al. |
| 2017/0090310 | A1* | 3/2017 | Katsuhara ..... G03G 5/0436 |
| 2017/0102633 | A1* | 4/2017 | Yoshidome ..... G03G 21/18 |
| 2018/0039201 | A1 | 2/2018 | Muranaka et al. |
| 2019/0369514 | A1 | 12/2019 | Watanabe et al. |
| 2019/0369529 | A1 | 12/2019 | Yagi et al. |
| 2020/0225593 | A1 | 7/2020 | Yamaguchi et al. |
| 2020/0264526 | A1 | 8/2020 | Shimozawa et al. |
| 2020/0292949 | A1 | 9/2020 | Ishiduka et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2021/0026295 | A1 | 1/2021 | Yamada et al. |
| 2021/0033996 | A1 | 2/2021 | Kikuchi et al. |

FOREIGN PATENT DOCUMENTS

| | | | |
|---|---|---|---|
| JP | 2006308743 | A | 11/2006 |
| JP | 2007079230 | A | 3/2007 |
| JP | 2008233442 | A | 10/2008 |
| JP | 2009150966 | A | 7/2009 |
| JP | 2014157308 | A | 8/2014 |
| JP | 2018025707 | A | 2/2018 |

OTHER PUBLICATIONS

U.S. Appl. No. 17/065,258, Kohei Makisumi, filed Oct. 7, 2020.
U.S. Appl. No. 17/069,919, Tsutomu Nishida, filed Oct. 14, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.

(56) References Cited

OTHER PUBLICATIONS

U.S. Appl. No. 17/071,103, Noriyoshi Umeda, filed Oct. 15, 2020.
U.S. Appl. No. 17/071,109, Shohei Kototani, filed Oct. 15, 2020.
U.S. Appl. No. 17/071,227, Kosuke Fukudome, filed Oct. 15, 2020.
U.S. Appl. No. 17/071,246, Tomohiro Unno, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/071,540, Tsuneyoshi Tominaga, filed Oct. 15, 2020.
U.S. Appl. No. 17/072,206, Satoru Nishioka, filed Oct. 16, 2020.

* cited by examiner

PROCESS CARTRIDGE AND ELECTROPHOTOGRAPHIC APPARATUS USING THE SAME

BACKGROUND OF THE INVENTION

Field of the Invention

The present disclosure relates to a process cartridge and an electrophotographic apparatus using the same.

Description of the Related Art

Investigations on improvement of image quality when using an electrophotographic apparatus or a process cartridge for a long period of time have hitherto been extensively conducted.

As an example, Japanese Patent Application Laid-Open No. 2002-003651 discloses a charging member including a rubber composition and an elastic layer formed of the rubber composition, the rubber composition containing a sea-island structure including a polymer continuous phase formed of an ionic conductive rubber material primarily containing a raw rubber A having an intrinsic volume resistivity of $1\times10^{12}$ Ω·cm or less and a polymer particulate phase formed of an electronic conductive rubber material obtained by mixing a conductive particle with a raw rubber B and thus having conductivity.

The charging member disclosed in Japanese Patent Application Laid-Open No. 2002-003651 includes the elastic layer formed of the rubber composition containing the sea-island structure in which the ionic conductive rubber material and the electronic conductive rubber material are contained, such that the charging member has a uniform electrical resistance. Therefore, electrical characteristics of the charging member are stable over time without being affected by environmental changes such as temperature and humidity.

In addition, Japanese Patent Application Laid-Open No. 2014-157308 discloses a charging device having charging capability improved by setting a surface roughness Rz and a surface resistance rs of a charging member, and a volume resistance rv of a portion between a surface and a core metal of the charging member to specific ranges.

In Japanese Patent Application Laid-Open No. 2018-025707, it is disclosed that, through continuous exposure history, negative charges are accumulated at an interface between a charge-generating layer and an intermediate layer, and sensitivity of an electrophotographic photosensitive member is thus reduced, and in a case where the electrophotographic photosensitive member includes a protective layer, positive charges are remained and accumulated at an interface between the protective layer and a charge-transporting layer, and the sensitivity of the electrophotographic photosensitive member is thus further reduced.

In addition, in Japanese Patent Application Laid-Open No. 2018-025707, it is also disclosed that after the exposure at the time of performing subsequent printing, a potential at a latent image formation portion which has received the continuous exposure history is reduced than a potential at a background portion, resulting in an occurrence of pattern memory.

The electrophotographic photosensitive member disclosed in Japanese Patent Application Laid-Open No. 2018-025707 is used as a unit for suppressing the pattern memory capable of appropriately dispersing the positive charges to be accumulated at the interface between the protective layer and the charge-transporting layer in the charge-transporting layer by attracting the positive charges present at the interface in an appropriate amount through the charge-transporting layer and thus suppressing a reduction in sensitivity to improve electron retention in the intermediate layer.

SUMMARY OF THE INVENTION

According to investigation conducted by the inventors, it was found that there still was a need to suppress the pattern memory under a low-temperature and low-humidity environment in the configurations disclosed in Japanese Patent Application Laid-Open Nos. 2002-003651, 2014-157308, and 2018-025707.

The pattern memory is a phenomenon in which when an image pattern having a solid black band part is output repeatedly to a portion of an output image in a circumferential direction of a drum, and then the entire halftone image with no solid black band part is output, a part which is originally the solid black band part of the image pattern having the solid black band part is output in a thin state in an entire halftone image.

This is because that since an increase of a potential at the solid black band part of the electrophotographic photosensitive member is large, the potential is not returned at the time of performing output of the entire halftone image in the subsequent print, and a toner concentration is thus reduced, and as a result, a portion at which a density of the image is small is generated in the entire halftone image. As a result of paying attention to the electrophotographic photosensitive member and the charging member, the inventors found that an increase of the potential can be suppressed by improving chargeability of the charging member and further improving sweeping of charges remaining in the electrophotographic photosensitive member, even though the image pattern having the solid black band part is output under a low-temperature and low-humidity environment.

One aspect of the present disclosure is directed to providing a process cartridge capable of suppressing an occurrence of pattern memory under a low-temperature and low-humidity environment. Further, another aspect of the present disclosure is directed to providing an electrophotographic apparatus capable of forming a high quality electrophotographic image.

According to one aspect of the present disclosure, there is provided a process cartridge integrally supporting at least an electrophotographic photosensitive member and a charging member and being detachably attachable to a main body of an electrophotographic apparatus, wherein the charging member includes a support having a conductive outer surface and a conductive layer provided on the outer surface of the support, the conductive layer has a matrix containing a first rubber and a plurality of domains dispersed in the matrix, the domain contains a second rubber and an electronic conductive agent, at least a part of domains is exposed to the outer surface of the charging member, the outer surface of the charging member is composed of at least the matrix and at least a part of domains, when a volume resistivity of the matrix is defined as Rcm and a volume resistivity of the domain is defined as Rcd, Rcm is $1.0\times10^{5}$ times or more of Rcd, an average value Sd of circle equivalent diameters of the domains observed on the outer surface of the charging member is 0.1 μm or more and 5.0 μm or less, the electrophotographic photosensitive member contains a support, a photosensitive layer, and a protective layer in this order, the protective layer contains a polymer of a composition containing a compound having a polymerizable group, and when a surface roughness of the protective layer is measured, a protruding valley portion Rvk is 0.01 μm or more and 0.10 μm or less and a load length ratio Mr2 is 75% or more and 85% or less, and Sd/Rvk is 1 or more and 100 or less.

According to another aspect of the present disclosure, there is provided an electrophotographic apparatus including an electrophotographic photosensitive member and a charging member, wherein the charging member includes a support having a conductive outer surface and a conductive layer provided on the outer surface of the support, the conductive layer has a matrix containing a first rubber and a plurality of domains dispersed in the matrix, the domain contains a second rubber and an electronic conductive agent, at least a part of domains is exposed to the outer surface of the charging member, the outer surface of the charging member is composed of at least the matrix and at least a part of domains, when a volume resistivity of the matrix is defined as Rcm and a volume resistivity of the domain is defined as Rcd, Rcm is $1.0\times10^5$ times or more of Rcd, an average value Sd of circle equivalent diameters of the domains observed on the outer surface of the charging member is 0.1 μm or more and 5.0 μm or less, the electrophotographic photosensitive member contains a support, a photosensitive layer, and a protective layer in this order, the protective layer contains a polymer of a composition containing a compound having a polymerizable group, and when a surface roughness of the protective layer is measured, a protruding valley portion Rvk is 0.01 μm or more and 0.10 μm or less and a load length ratio Mr2 is 75% or more and 85% or less, and Sd/Rvk is 1 or more and 100 or less.

Further features of the present invention will become apparent from the following description of exemplary embodiments with reference to the attached drawings.

DESCRIPTION OF THE EMBODIMENTS

Figure 1:
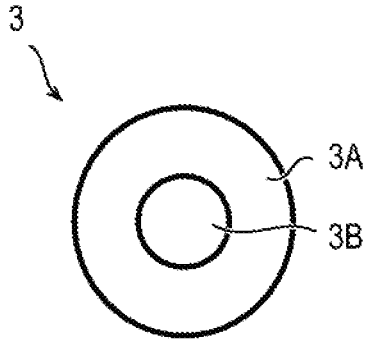
FIG. 1 is a cross-sectional view of a charging member included in a process cartridge according to an embodiment of the present disclosure in a direction perpendicular to a longitudinal direction of the charging member.

Hereinafter, the present disclosure will be described in detail with reference to preferred embodiments.

According to an embodiment of the present disclosure, there is provided a process cartridge integrally supporting at least an electrophotographic photosensitive member and a charging member and being detachably attachable to a main body of an electrophotographic apparatus, wherein the charging member includes a support having a conductive outer surface and a conductive layer provided on the outer surface of the support, the conductive layer has a matrix containing a first rubber and a plurality of domains dispersed in the matrix, the domain contains a second rubber and an electronic conductive agent, at least a part of domains is exposed to the outer surface of the charging member, the outer surface of the charging member is composed of at least the matrix and at least a part of domains, when a volume resistivity of the matrix is defined as Rcm and a volume resistivity of the domain is defined as Rcd, Rcm is $1.0\times10^5$ times or more of Rcd, an average value Sd of circle equivalent diameters of the domains observed on the outer surface of the charging member is 0.1 μm or more and 5.0 μm or less, the electrophotographic photosensitive member contains a support, a photosensitive layer, and a protective layer in this order, the protective layer contains a polymer of a composition containing a compound having a polymerizable group, and when a surface roughness of the protective layer is measured, a protruding valley portion Rvk is 0.01 μm or more and 0.10 μm or less and a load length ratio Mr2 is 75% or more and 85% or less, and Sd/Rvk is 1 or more and 100 or less.

The inventors presume the reason why an occurrence of pattern memory can be suppressed by the process cartridge even in a low-temperature and low-humidity environment as follows.

In the charging member included in the process cartridge, the conductive layer has a domain-matrix structure having a domain which is a conductive phase in which many portions filled with a large amount of charges are arranged in advance and a matrix which is an insulating phase. By this configuration, the charges move in the domain and reach a surface of the charging member, such that the charges can be abundantly and intensively present in the domain over the entire charging member. Therefore, the charges are supplied from an adjacent domain even though the charges are consumed by discharge. As a result, a discharge defect in the charging member is suppressed.

In the electrophotographic photosensitive member (hereinafter, also referred to as a "photosensitive member") receiving the charges released from the charging member, a charge distribution corresponding to the domain-matrix structure of the charging member is generated. In this case, the charges are released from the domain of the charging member, the discharge defect hardly occurs, and the charges are released to the photosensitive member in various directions. Therefore, a surface of the protective layer of the photosensitive member has roughness within the range of the present disclosure, such that the charges are efficiently released from the charging member to each of a wall surface, a valley portion, and a peak portion of the surface of the protective layer on which the roughness is formed. That is, the photosensitive member having the roughness within the range of the present disclosure efficiently receives the charges that are released from the domain in various directions.

As a result, it is considered that a charge density on the surface of the protective layer of the photosensitive layer is increased, such that the charges remaining in the photosensitive member are easily swept out, and a potential increase in the photosensitive member is suppressed, thereby suppressing the pattern memory.

Hereinafter, a specific configuration will be described.

Since discharge from the surface of the charging member to the surface of the photosensitive member is required, the photosensitive member and the charging member being included in the process cartridge according to an embodiment of the present disclosure, a predetermined difference between the volume resistivities of the matrix and the domain is required, or the domain in the domain-matrix structure is required to have a fine structure.

In a case where the volume resistivity of the matrix is defined as Rcm and the volume resistivity of the domain is defined as Rcd, when Rcm is $1.0\times10^5$ times or more of Rcd, the discharge from the charging member to the photosensitive member is stably performed. When Rcm is less than $1.0\times10^5$ times Rcd, the discharge defect is likely to occur, and the discharge from the charging member to the photosensitive member is thus unstably performed.

Since supply of the charges from the domain is important, the average value Sd of the circle equivalent diameters of the domains is also important. That is, when the average value Sd of the circle equivalent diameters of the domains observed on the outer surface of the charging member is 0.1 μm or more and 5.0 μm or less, in the charging member, a path through which the charges move in the domain-matrix structure can be limited. In addition, as a ratio of a surface area of the domain to a volume of the domain is large, the charges are more efficiently released at an interface of the domain exposed to the outer surface of the charging member. That is, the charges are released from the domain to the photosensitive member in various directions, such that the charge density on the surface of the photosensitive member is increased, and the effect of suppressing the occurrence of the pattern memory is thus improved. When the average value Sd of the circle equivalent diameters of the domains is 0.1 μm or more and 5.0 μm or less, unevenness in the discharge from the charging member to the photosensitive member does not occur, and the charge density on the surface of the protective layer is increased. Thus, the effect of suppressing the occurrence of the pattern memory is sufficiently exerted. In addition, an occurrence of image unevenness can also be suppressed.

The average value Sd of the circle equivalent diameters of the domains is more preferably 0.1 μm or more and 1.0 μm or less. Within this range, electrical resistance of the domain itself can be reduced, and a single discharge amount is thus increased.

In addition, in a case where the surface roughness of the protective layer of the photosensitive member included in the process cartridge according to an embodiment of the present disclosure is measured, when the protruding valley portion Rvk is 0.01 μm or more and 0.10 μm or less and the load length ratio Mr2 is 75% or more and 85% or less, the photosensitive member can efficiently receive the charges released from the charging member having the surface to which the domains are exposed, the domains having the above range of the average value Sd of the circle equivalent diameters of the domains.

When Rvk is less than 0.01 μm, the photosensitive member cannot efficiently receive the charges, such that the charge density on the surface of the protective layer is not increased. Thus, the effect of suppressing the occurrence of the pattern memory is reduced. In addition, when Rvk is more than 0.10 μm, a depth of the protruding valley portion of the surface roughness of the protective layer is increased, and thus, the discharge is not sufficiently performed, and the charge density on the surface of the protective layer is not increased. As a result, the effect of suppressing the occurrence of the pattern memory is reduced.

More preferably, when Rvk is 0.01 μm or more and 0.05 μm or less, the effect of suppressing the occurrence of the pattern memory is improved.

In addition, when Sd/Rvk is 1 or more and 100 or less, an optimal configuration in which the photosensitive member efficiently receives the charges is implemented, and the effect of suppressing the occurrence of the pattern memory is improved. More preferably, when Sd/Rvk is 5 or more and 80 or less, an optimal configuration in which the photosensitive member efficiently receives the charges is implemented, and the effect of suppressing the occurrence of the pattern memory is improved.

For example, when the average value Sd of the circle equivalent diameters of the domains is 5 μm and the protruding valley portion Rvk of the surface of the protective layer is 0.01 μm, Sd/Rvk is 500, which does not satisfy the requirements of the present disclosure. This is because that when the average value Sd of the circle equivalent diameters of the domains is too larger with respect to a value of the surface roughness of the protective layer, the charge density on the surface of the protective layer cannot be increased, and the effect of suppressing the occurrence of the pattern memory is thus reduced.

In addition, when the average value Sd of the circle equivalent diameters of the domains is 0.1 μm and the protruding valley portion Rvk of the surface of the protective layer is 0.11 μm, Sd/Rvk is 0.9, which does not satisfy the requirements of the present disclosure. This is because that the charge density on the surface of the protective layer is increased, but the image unevenness occurs and uniformity of the charge density on the surface of the protective layer is deteriorated. Thus, the effect of suppressing the occurrence of the pattern memory is reduced.

In addition, when Mr2 is less than 75%, the number of protruding valley portions is small, and the charge density on the surface of the protective layer is thus not increased.

In addition, when Mr2 is more than 85%, since the number of protruding valley portions is large, the charge density on the surface of the protective layer is increased, but, as an adverse effect, a toner or an additive additionally added to the toner is slipped, and the surface of the charging member is thus contaminated. In addition, the image unevenness also occurs.

Further, when an average interval Sm of irregularities of the protective layer is 10 μm or more and 40 μm or less, the photosensitive member can more efficiently receive the charges. Thus, the charge density can be further increased and the occurrence of the pattern memory can thus be more suppressed.

Further, when an average value Dms of distances between wall surfaces of a domain and an adjacent domain that are observed on the outer surface of the charging member is 0.2 μm or more and 6 μm or less, conductivity between the domains is further secured and a density of the charges released to the surface of the photosensitive member is more increased, and the occurrence of the pattern memory can thus be more suppressed.

In addition, when the protective layer contains at least a polymer of a composition containing a compound having a triarylamine structure, the charges are more efficiently transported and the charges remaining in the photosensitive member are easily swept out, and the occurrence of the pattern memory can thus be more suppressed.

In addition, when a contact width between the electrophotographic photosensitive member and the charging member is 500 μm or more and 800 μm or less, the configuration according to the present disclosure has an optimal configuration in which the photosensitive member efficiently receives the charges, and the occurrence of the pattern memory can thus be more suppressed.

Next, the charging member according to one aspect of the present disclosure will be described in detail.

<Charging Member>

The charging member will be described with reference to FIG. 1 by taking an example of a charging member having a roller shape (hereinafter, also referred to as a "charging roller"). FIG. 1 is a cross-sectional view of a charging roller 3 perpendicular to a direction along an axis of the charging roller 3 (hereinafter, also referred to as a "longitudinal direction"). The charging roller 3 includes a cylindrical conductive support 3B and a conductive layer 3A formed on an outer circumference of the support 3B, that is, an outer surface of the support.

<Support>

As a material constituting the support, a material known in the field of a conductive member for electrophotography or a material that can be used as a conductive member can be adequately selected and used. Examples of the material can include aluminum, stainless steel, a synthesis resin having conductivity, a metal or an alloy such as iron and a copper alloy.

In addition, these materials may be subjected to an oxidation treatment or a plating treatment with chrome or nickel. As a type of plating, either electroplating or electroless plating can be used. The electroless plating is preferable from the viewpoint of dimensional stability. Here, examples of a type of electroless plating to be used can include nickel plating, copper plating, gold plating, and plating with other various alloys.

A thickness of the plating is preferably 0.05 μm or more, and it is preferable that the thickness of the plating is 0.10 μm to 30.00 μm in consideration of a balance between working efficiency and rust proof ability. The cylindrical shape of the support may be a solid cylindrical shape or a hollow cylindrical (tubular) shape. In addition, an outer diameter of the support is preferably in a range of 3 mm to 10 mm.

When a medium-resistance layer or an insulation layer is present between the support and the conductive layer, the charges cannot be quickly supplied after the consumption of the charges by the discharge in some cases. Therefore, it is preferable that the conductive layer is directly provided on the support or the conductive layer is provided on an outer circumference of the support only via an intermediate layer which is a thin film and is formed of a conductive resin layer such as a primer, the intermediate layer being interposed between the support and the conductive layer.

As the primer, a known primer can be selected depending on a rubber material for conductive layer formation, a material of a support, and the like. Examples of a material of the primer can include a thermosetting resin and a thermoplastic resin, and specific examples thereof can include known materials such as a phenol-based resin, a urethane-based resin, an acrylic resin, a polyester-based resin, a polyether-based resin, and an epoxy-based resin.

<Conductive Layer>

The conductive layer has a matrix and a domain.

<Matrix>

The matrix contains a first rubber.

<First Rubber>

The first rubber is a component mixed in a rubber mixture for forming a conductive layer at the largest mixing ratio, and mechanical strength of the conductive layer depends on a first rubber cross-linked product. Therefore, a rubber that exhibits strength of the conductive layer required for a charging member for an electrophotographic apparatus after the cross-linking is used as the first rubber.

Preferred examples of the first rubber can include the following, but are not limited thereto.

Examples of the first rubber can include natural rubber (NR), isoprene rubber (IR), butadiene rubber (BR), styrene-butadiene rubber (SBR), butyl rubber (IIR), ethylene-propylene rubber (EPM), ethylene-propylene-diene terpolymer rubber (EPDM), chloroprene rubber (CR), acrylonitrile-butadiene rubber (NBR), hydrogenated NBR (H-NBR), an epichlorohydrin homopolymer or an epichlorohydrin-ethylene oxide copolymer, an epichlorohydrin-ethylene oxide-allyl glycidyl ether terpolymer, and silicone rubber.

<Reinforcing Agent>

A reinforcing agent can be contained in the matrix to an extent that does not affect the conductivity of the matrix. An example of the reinforcing agent can include reinforcing carbon black having low conductivity. Specific examples of the reinforcing carbon black can include FEF, GPF, SRF, and MT carbons.

In addition, a filler, a processing aid, a vulcanization aid, a vulcanization accelerator, a vulcanization accelerator aid, a vulcanization retardant, an antioxidant, a softener, a dispersant, a coloring agent, and the like that are generally used for a rubber compounding agent may be added to the first rubber constituting the matrix, if necessary.

<Domain>

The domain contains a second rubber and a conductive particle.

<Second Rubber>

Specific examples of rubber that can be used as the second rubber can include the following, but are not limited thereto.

Examples of the second rubber can include natural rubber (NR), isoprene rubber (IR), butadiene rubber (BR), styrene-butadiene rubber (SBR), butyl rubber (IIR), ethylene-propylene rubber (EPM), ethylene-propylene-diene terpolymer rubber (EPDM), chloroprene rubber (CR), acrylonitrile-butadiene rubber (NBR), hydrogenated NBR (H-NBR), silicone rubber, and urethane rubber (U).

<Conductive Particle>

The volume resistivity of the domain can be determined by appropriately selecting the amount and type of the conductive particle with respect to the second rubber in the domain and setting the conductivity of the conductive particle to a predetermined value.

Examples of a material of the conductive particle can include an ionic conductive agent; a carbon material such as conductive carbon black or graphite; metal oxide such as titanium oxide or tin oxide; a metal such as Cu or Ag; and an electronic conductive particle such as a particle having a surface that is coated with metal oxide or a metal to have conductivity. These conductive particles may be used in an appropriate combination of two or more thereof.

Among them, as the material of the conductive particle, conductive carbon black is preferably used. Specific examples of the conductive carbon black can include the following, but are not limited thereto. Examples of the conductive carbon black can include gas furnace black, oil furnace black, thermal black, lamp black, acetylene black, and Ketjen black.

Among them, particularly, carbon black having a dibutyl phthalate (DBP) absorption amount of 40 $cm^3$/100 g or more and 80 $cm^3$/100 g or less can be adequately used. The DBP absorption amount ($cm^3$/100 g) indicates a volume of dibutyl phthalate (DBP) that can be adsorbed to 100 g of carbon black and is measured in accordance with Japan Industrial Standard (JIS) K 6217-4:2017 (Carbon black for rubber, Fundamental characteristics, Part 4: Method of calculating an oil absorption amount (including a compressed sample)).

In general, carbon black has a tufted higher order structure in which primary particles having an average particle size of 10 nm or more and 50 nm or less are aggregated. The tufted higher order structure is called a structure, and a degree thereof is quantified by the DBP absorption amount ($cm^3$/100 g).

In the case of the conductive carbon black of which the DBP absorption amount is within the above range, carbon black is less aggregated and dispersibility in rubber is excellent due to no or less development of the structure. Therefore, the amount of the conductive particles filled in the domain is increased, and a range of adjusting the volume resistivity of the domain is widened.

<Method of Forming Domain-Matrix Structure>

A specific method of forming the domain-matrix structure in the conductive layer will be described.

A structure of the domain of the conductive phase and the matrix of the insulating phase can be obtained by a method of phase-separating or dispersing a conductive material and an insulating material within a range in which the effects of the present disclosure are not impaired.

In order for the charging member for the electrophotographic apparatus to bring into contact with another member and to stably exhibit its function, the conductive layer of the charging member necessarily has an elastic layer having a domain-matrix type phase separation structure in which phases of a matrix containing a first rubber having insulating characteristics and a domain containing a second rubber having conductive characteristics are separated.

An example of a method of forming the domain-matrix type phase separation structure can include a method of forming a phase separation structure by kneading two types of non-compatible rubber materials.

An example of a parameter representing compatibility/non-compatibility includes an SP value. The SP value is a square root of cohesive energy density of a molecule, and represents a magnitude of a cohesive force between molecules (intermolecular cohesive force). Therefore, a difference in SP value between both molecules is optimized, such that a mixing (compatible) state can be controlled and the phase separation structure can thus be controlled. A SP value of rubber can be adjusted by selection of a material or a selection of a copolymerization ratio of a segment having a polar group.

In order to form the domain-matrix structure, a difference in SP value between two types of the rubber materials is preferably 5.0 or less. The SP value is more preferably 2.0 or less, and in this case, a domain-matrix structure including a domain having a smaller size can be formed. In addition, the SP value can be accurately calculated by preparing a calibration curve using a material of which an SP value is known. As the known SP value, a catalog value of a raw material manufacturer can be used.

Specifically, for example, the domain-matrix structure can be formed by a method including the following steps (i) to (iv):

Step (i): a step of preparing a rubber mixture for domain formation (hereinafter, also referred to as "CMB"), the rubber mixture containing a conductive particle and a second rubber;

Step (ii): a step of preparing a rubber mixture for matrix formation (hereinafter, also referred to as "MRC"), the rubber mixture containing a first rubber;

Step (iii): a step of preparing a rubber mixture having a domain-matrix structure by kneading the CMB and the MRC; and Step (iv): a step of forming a conductive layer of a charging member by forming the rubber mixture prepared in the step (iii) on an outer surface of a conductive support and curing the rubber mixture layer.

<Method of Confirming Domain-Matrix Structure>

The presence or absence of the formation of the domain-matrix structure in the conductive layer can be confirmed by the following method.

The presence or absence of the formation of the domain-matrix structure in the conductive layer of the charging member can be confirmed by the following method.

A piece (thickness of 500 μm) is cut out using a razor so that a cross section orthogonal to a longitudinal direction of the conductive layer of the charging member can be observed. In addition, a piece is also cut out so that the outer surface of the charging member can be observed. Next, platinum vapor deposition is performed on each piece, and an image of the piece is captured with a scanning electron microscope (SEM) (trade name: S-4800, manufactured by Hitachi High-Technologies Corporation) at a magnification of 1,000 to 5,000, thereby obtaining an image.

Figure 2:
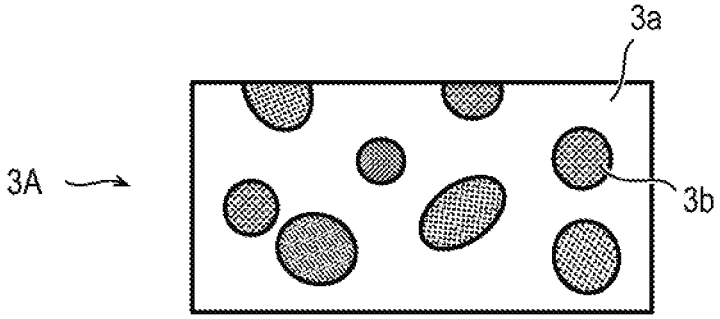
FIG. 2 is a schematic view of an outer surface of the charging member included in the process cartridge according to an embodiment of the present disclosure.

As illustrated in FIG. 2, it is preferable that a plurality of domains 3*b* are dispersed in a matrix 3*a* and the domains are present independently of each other without being in contact with each other in the captured image. Meanwhile, it is preferable that the matrix is in a continuous state in the image and the domain is separated by the matrix.

In order to quantify the captured cross section image, a 256 grayscale monochrome image of the image obtained by the observation with the SEM is obtained by performing 8-bits grayscale using image processing software (trade name: ImageProPlus, manufactured by Media Cybernetics, Inc.). Next, a white and black image inversion processing is performed so that the domain in the image becomes white, and a binarization threshold is set based on the algorithm of Otsu's discrimination analysis method for a luminance distribution of the image, and then the binarized image is obtained.

By a function of counting the binarized image, as described above, a percent K of the number of domains that are not connected to each other and isolated with respect to the total number of domains that are present in a region having the 50 μm square and do not have a contact point with a frame of the binarized image is calculated.

Pieces are prepared from 20 points in total, the 20 points being obtained from arbitrary one point of each of regions obtained by evenly dividing the conductive layer of the charging member (charging roller) into five in the longitudinal direction, and evenly dividing the conductive layer into four in a circumferential direction, and then an arithmetic mean value (number %) of K when performing the measurement is calculated.

When the arithmetic mean value (number %) of K is 80 or more, the domain-matrix structure can be evaluated as "presence", and when the arithmetic mean value (number %) of K is less than 80, the domain-matrix structure can be determined as "absence".

<Volume Resistivity Rcm of Matrix>

The volume resistivity Rcm of the matrix is preferably $1.0\times10^7$ Ω·cm or more and $1.0\times10^{17}$ Ω·cm or less, and in this case, the matrix enables the suppression of inhibition of transfer of the charges between the conductive domains. In addition, when a charge bias is applied to a portion between the conductive support and a charged member, the discharge from the charging member to the charged member can be smoothly performed.

<Measurement Method of Volume Resistivity Rcm of Matrix>

After the charging member is thinned, the volume resistivity Rcm of the matrix can be measured with a microprobe. Examples of a unit for thinning a piece can include a sharp razor, a microtome, and a focused ion beam (FIB).

In preparation of a thin piece, it is required to eliminate an influence on the domain and to measure only the volume resistivity of the matrix. Accordingly, it is required to prepare a thin piece having a thickness smaller than a distance between the domains measured in advance with an SEM, a transmission electron microscope (TEM), or the like. Therefore, as a unit for thinning a piece, a unit capable of preparing a very thin sample such as a microtome is preferable.

In the measurement of the volume resistivity of the matrix, first, one surface of the thin piece is grounded, and then locations of the matrix and the domains in the thin piece are specified by a unit that can measure the volume resistivity or a hardness distribution of each of the matrix and the domain, with a scanning probe microscope (SPM), an atomic force microscope (AFM), or the like. Next, a probe is brought into contact with the matrix and a direct current (DC) voltage of 10 V to 50 V is applied to the matrix for 5 seconds, and an arithmetic mean value of ground current values for 5 seconds is measured and divided by the voltage, thereby calculating an electrical resistance value. In addition, the electrical resistance value is preferably converted into a volume resistivity by using the thickness of the thin piece. In this case, in a case where a unit that can also measure a shape of the thin piece such as the SPM or the AFM, the thickness of the thin piece can be measured, and the volume resistivity can be also measured, which is preferable.

<Volume Resistivity Rcd of Domain>

When the volume resistivity of the matrix is defined as Rcm and the volume resistivity of the domain is defined as Rcd, Rcm is $1.0\times10^5$ times or more of Rcd. In addition, the volume resistivity Rcd of the domain is preferably $1.0\times10^4$ Ω·cm or less. As the volume resistivity of the domain is set to be small, the movement of the charges in the matrix can be suppressed, and a transport path of the charges can be limited to the domain.

<Measurement Method of Volume Resistivity Rcd of Domain>

The volume resistivity Rcd of the domain may be measured in the same method as that of the measurement method of the volume resistivity of the matrix, except that measurement locations are changed to locations corresponding to the domains, and an application voltage when measuring the current value is changed to 1 V.

Specifically, the volume resistivity of the domain is measured in the same method as that of the measurement method of the volume resistivity of the matrix, except that the measurement is performed at the locations corresponding to the domains in an ultra thin piece and the measurement voltage is set to 1 V.

<Average Value Sd of Circle Equivalent Diameters of Domains Observed on Outer Surface of Conductive Layer>

The average value Sd of the circle equivalent diameters of the domains observed on the outer surface of the conductive layer is 0.1 μm or more and 5.0 μm or less.

<Measurement Method of Average Value Sd of Circle Equivalent Diameters of Domains Observed on Outer Surface of Conductive Layer>

In the measurement of the average value Sd of the circle equivalent diameters of the domains observed on the outer surface of the conductive layer, the circle equivalent diameters ($=(4S/\pi)^{0.5}$) of the domains are calculated from an arithmetic mean value Ss of plane areas of the domains exposed when the outer surface of the conductive layer of the charging member is observed.

Specifically, when a length of the conductive layer in the longitudinal direction is defined as L, samples including the outer surface of the conductive layer are cut out from three portions located at the center of the conductive layer in the longitudinal direction and at two portions corresponding to L/4 from both ends of the conductive layer to the center of the conductive layer, respectively, using a microtome (trade name: Leica EM FCS, manufactured by Leica Microsystems). A thickness of the sample is set to 1 μm.

A surface of the sample corresponding to the outer surface of the conductive layer is subjected to vapor deposition of platinum. Any three portions on each of the platinum vapor deposited surfaces of the samples are selected and images thereof are captured with a scanning electron microscope (SEM) (trade name: S-4800, manufactured by Hitachi High-Technologies Corporation) at a magnification of 1,000 to 5,000. Each of the nine captured images is binarized using image processing software (trade name: ImageProPlus, manufactured by Media Cybernetics, Inc.), the binarized images are quantified by a counting function, and the arithmetic mean value Ss of the plane areas of the domains included in each of the capture images is calculated. Next, the circle equivalent diameters ($=(4S/\pi)^{0.5}$) of the domains are calculated from the arithmetic mean value Ss of the plane areas of the domains calculated from each of the captured images. Next, an arithmetic mean value of the circle equivalent diameters of the domains in each of the captured images is calculated, and then, when the outer surface of the conductive layer which is an object to be measured is observed, the average value Sd of the circle equivalent diameters of the domains is obtained.

<Method of Controlling Average Value Sd of Circle Equivalent Diameters of Domains>

A method of controlling the average value Sd of the circle equivalent diameters of the domains is as follows.

For a dispersion particle size (D) when two types of incompatible polymers are melted and kneaded, the Taylor's equation represented by the following Equation (a), the Wu's empirical equation represented by the following Equations (b) and (c), and the Tokita's equation represented by the following Equation (d) are proposed.

Taylor's Equation $$D=[C\cdot\sigma/\eta m\cdot\gamma]:f(\eta m/\eta d) \quad \text{Equation (a)}$$

Wu's Empirical Equation $$\gamma\cdot D\cdot\eta m/\sigma=4(\eta d/\eta m)0.84\cdot\eta d/\eta m>1 \quad \text{Equation (b)}$$

$$\gamma\cdot D\cdot\eta m/\sigma=4(\eta d/\eta m)-0.84\cdot\eta d/\eta m<1 \quad \text{Equation (c)}$$

Tokita's Equation $$D=f((1/\eta)^*(1/\gamma)^*(\eta d/\eta m)^*P^*\varphi^*\sigma^*(1/EDK)^*(1/\tau)^*\chi12) \quad \text{Equation (d)}$$

In Equations (a) to (d), D represents a dispersed particle diameter, C represents an integer, σ represents an interfacial tension, ηm represents a viscosity of a matrix, ηd represents a viscosity of a domain, γ represents a shear rate, η represents a viscosity of a mixture system, P represents a collision coalescence probability, φ represents a phase volume of the domain, and EDK represents a domain phase-cut energy.

As shown in the above equations, the dispersed particle diameter D can be controlled mainly by the following 4 points, and the average value Sd of the circle equivalent diameters of the domains observed on the outer surface of the charging member can also be controlled.

(1) Interfacial Tension Difference between Domain and Matrix (2) Ratio of Viscosity of Domain to Viscosity of Matrix (3) Shear Rate during Mixing/Energy Amount during Shearing (4) Volume Fraction of Domain Since the interfacial tension correlates with the difference in SP value between the domain and the matrix, the interfacial tension can be controlled by selection of a raw rubber or the like of each of the matrix and the domain.

In addition, as a ratio (ηd/ηm) of a viscosity of the domain to a viscosity of the matrix is closer to 1, the average value Sd of the circle equivalent diameters of the domains can be decreased. The ratio of the viscosity of the raw rubber of the domain to the viscosity of the raw rubber of the matrix can be adjusted by selection of the Mooney viscosity of the raw rubber, or the type or amount of filler to be added. In addition, it is also possible to add a plasticizer such as paraffin oil to an extent that does not inhibit the formation of the phase-separation structure. Further, the viscosity ratio can be adjusted by adjusting a temperature during kneading. As a shear rate during mixing/an energy amount during shearing is large, the average value Sd of the circle equivalent diameters of the domains can be decreased and adjusted under kneading conditions. A volume fraction of the domain can be adjusted within a range of a resistance region required for the charging member.

<Average Value Dms of Distances between Wall Surfaces of Domains on Outer Surface of Conductive Layer>

The average value Dms of the distances between the wall surfaces of the domains on the outer surface of the conductive layer is preferably 0.2 μm or more and 6 μm or less, from the viewpoint of the density of the charges released to the photosensitive member. The term "adjacent domain" used herein refers to a domain closest to a certain domain.

The average value Dms of the distances between the wall surfaces of the domains is more preferably 0.2 μm or more and 2 μm or less. Within this range, the electrical resistance of the domain itself can be reduced, and a single discharge amount can thus be increased.

<Measurement Method of Average Value Dms of Distances between Wall Surfaces of Domains on Outer Surface of Conductive Layer>

In the measurement of the average value Dms of the distances between the wall surfaces of the domains, the average value Dms of the distances between the wall surfaces of the domains can be evaluated in the same manner as that of the measurement method of the average value Sd of the circle equivalent diameters of the domains.

That is, a distribution of distances between wall surfaces of a domain and an adjacent domain on a binarized image is calculated, and a value obtained by calculating an arithmetic mean value of the distributions is defined as the average value Dms of the distances between the wall surfaces of the domains. In this case, the distance between the wall surfaces of domains is the shortest distance between the wall surfaces of the domain and the adjacent domain.

Control Method of Average Value Dms of Distances between Wall Surfaces of Domains on Outer Surface of Conductive Layer The average value Dms of the distances between the wall surfaces of the domains can be uniformly controlled by the method of controlling the average value Sd of the circle equivalent diameters of the domains.

Next, the electrophotographic photosensitive member included in the process cartridge according to an embodiment of the present disclosure will be described in detail.

[Electrophotographic Photosensitive Member]

In the electrophotographic photosensitive member, a conductive layer, a photosensitive layer, and a protective layer are stacked on a support in this order.

An example of a method of producing the electrophotographic photosensitive member can include a method in which coating liquids for layers to be described below are prepared and applied on the layers in a desired order, and the coating layers are dried. In this case, examples of a method of applying a coating liquid can include dip coating, spray coating, ink jet coating, roll coating, die coating, blade coating, curtain coating, wire bar coating, and ring coating. Among them, dip coating is preferable from the viewpoints of efficiency and productivity.

Hereinafter, the respective layers will be described.

<Support>

The support is preferably a support having conductivity. In addition, examples of a shape of the support can include a cylindrical shape, a belt shape, and a sheet shape. Among them, a cylindrical support is preferable. In addition, an outer surface of the support may be subjected to an electrochemical treatment such as anodization to form an oxide film, and may be subjected to a blast treatment, or a cutting treatment. As a material of the support, a metal, a resin, or glass is preferable.

Examples of the metal can include aluminum, iron, nickel, copper, gold, and stainless steel, or alloys thereof. Among them, an aluminum support formed of aluminum is preferable. More preferably, the support has an outer surface coated with an oxide film and is formed of an aluminum alloy. In a case where the support has an oxide film, since injection of charges from the support can be suppressed, charging stability is high.

In addition, conductivity may be imparted to the resin or glass through a treatment such as mixing or coating of the resin or glass with an conductive material.

<Conductive Layer>

The conductive layer may be provided on the support. By providing the conductive layer, scratches or irregularities of the surface of the support can be concealed, or reflection of light on the surface of the support can be controlled.

The conductive layer preferably contains a conductive particle and a resin.

Examples of a material of the conductive particle can include metal oxide, a metal, and carbon black.

Examples of the metal oxide can include zinc oxide, aluminum oxide, indium oxide, silicon oxide, zirconium oxide, tin oxide, titanium oxide, magnesium oxide, antimony oxide, and bismuth oxide. Examples of the metal can include aluminum, nickel, iron, nichrome, copper, zinc, and silver.

Among them, the metal oxide is preferably used for the conductive particle. In particular, titanium oxide, tin oxide, or zinc oxide is more preferably used for the conductive particle.

In a case where the metal oxide is used for the conductive particle, a surface of the metal oxide may be treated with a silane coupling agent or the like, or the metal oxide may be doped with an element such as phosphorus or aluminum, or an oxide thereof.

In addition, the conductive particle may have a laminate structure having a core particle and a covering layer that covers the particle. Examples of a material of the core particle can include titanium oxide, barium sulfate, and zinc oxide. An example of a material of the covering layer can include metal oxide such as tin oxide.

In addition, in a case where the metal oxide is used for the conductive particle, a volume average particle diameter thereof is preferably 1 nm or more and 500 nm or less, and more preferably 3 nm or more and 400 nm or less.

Examples of the resin can include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a masking agent such as silicone oil, a resin particle, or titanium oxide.

An average thickness of the conductive layer is preferably 1 μm or more and 50 μm or less, and particularly preferably 3 μm or more and 40 μm or less.

The conductive layer can be formed by preparing a coating liquid for a conductive layer containing the respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent. Examples of a method for dispersing the conductive particles in the coating liquid for a conductive layer can include methods using a paint shaker, a sand mill, a ball mill, and a liquid collision-type high-speed disperser.

<Undercoat Layer>

An undercoat layer may be provided on the support or the conductive layer. By providing the undercoat layer, an adhesive function between layers can be increased to impart a charge injection-inhibiting function.

The undercoat layer preferably contains a resin. In addition, the undercoat layer may be formed as a cured film by polymerization of a composition containing a monomer having a polymerizable functional group.

Examples of the resin can include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group included in the monomer having a polymerizable functional group can include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron transporting substance, metal oxide, a metal, a conductive polymer, and the like, in order to improve electric characteristics. Among them, an electron transporting substance or metal oxide may be preferably used.

Examples of the electron transporting substance can include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting substance having a polymerizable functional group may be used as the electron transporting substance and copolymerized with the monomer having the polymerizable functional group to form an undercoat layer as a cured film.

Examples of the metal oxide can include indium tin oxide, tin oxide, indium oxide, titanium oxide, zinc oxide, aluminum oxide, and silicon dioxide. Examples of the metal can include gold, silver, and aluminum.

In addition, the undercoat layer may further contain an additive.

An average thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating liquid for an undercoat layer containing the respective materials and a solvent, forming a coating film thereof, and drying and/or curing the coating film. Examples of the solvent used in the coating liquid can include an alcohol-based solvent, a ketone-based solvent, an ether-based solvent, an ester-based solvent, and an aromatic hydrocarbon-based solvent.

<Photosensitive Layer>

A photosensitive layer of the electrophotographic photosensitive member is provided on the support, the conductive layer, or the undercoat layer, and is mainly classified into (1) a laminate type photosensitive layer and (2) a monolayer type photosensitive layer. (1) The laminate type photosensitive layer includes a charge-generating layer containing a charge generating substance and a charge-transporting layer containing a charge-transporting substance. (2) The monolayer type photosensitive layer includes a photosensitive layer containing both a charge generating substance and a charge-transporting substance.

(1) Laminate Type Photosensitive Layer

The laminate type photosensitive layer includes a charge-generating layer and a charge-transporting layer.

(1-1) Charge-Generating Layer

The charge-generating layer preferably contains a charge generating substance and a resin.

Examples of the charge generating substance can include an azo pigment, a perylene pigment, a polycyclic quinone pigment, an indigo pigment, and a phthalocyanine pigment. Among them, an azo pigment or a phthalocyanine pigment is preferable. Among the phthalocyanine pigments, an oxytitanium phthalocyanine pigment, a chlorogallium phthalocyanine pigment, or a hydroxygallium phthalocyanine pigment is preferable.

A content of the charge generating substance in the charge-generating layer is preferably 40% by mass or more and 85% by mass or less, and more preferably 60% by mass or more and 80% by mass or less, with respect to a total mass of the charge-generating layer.

Examples of the resin can include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferable.

In addition, the charge-generating layer may further contain an additive such as an antioxidant or an ultraviolet absorber. Specific examples thereof can include a hindered phenol compound, a hindered amine compound, a sulfur compound, a phosphorus compound, and a benzophenone compound.

An average thickness of the charge-generating layer is preferably 0.1 μm or more and 1 μm or less, and more preferably 0.15 μm or more and 0.4 μm or less.

The charge-generating layer can be formed by preparing a coating liquid for a charge-generating layer containing the respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains a charge-transporting substance and a resin.

Examples of the charge-transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferable to improve the effect of suppressing black spots.

A content of the charge-transporting substance in the charge-transporting layer is preferably 25% by mass or more and 70% by mass or less, and more preferably 30% by mass or more and 55% by mass or less, with respect to a total mass of the charge-transporting layer. As a specific example, the charge-transporting substance is represented by each of Structural Formulas (C-1) to (C-6).

(C-1)

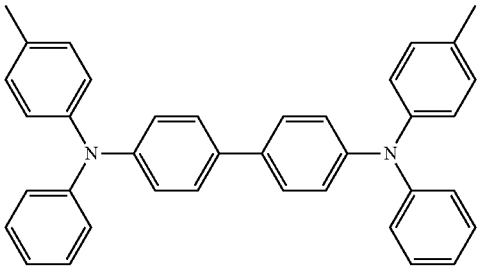

(C-2)

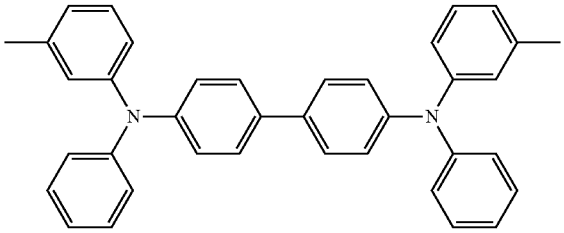

(C-3)

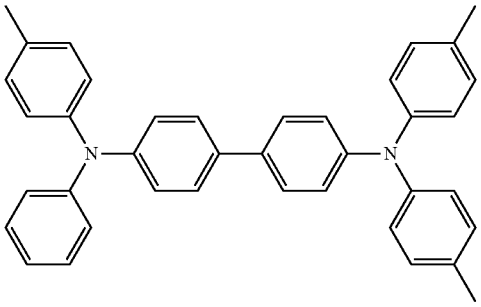

-continued (C-4)

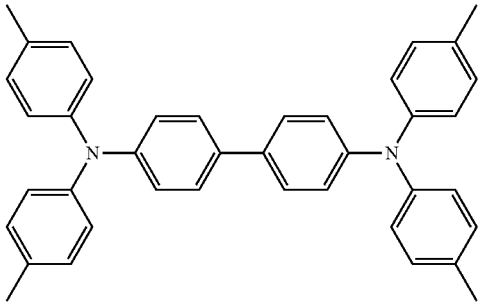

(C-5)

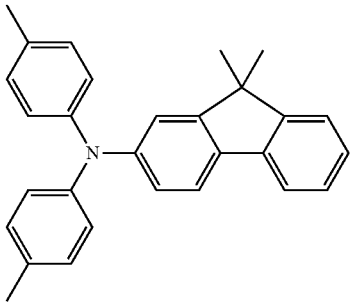

(C-6)

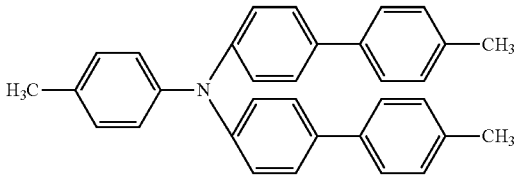

Examples of the resin can include a polyester resin, a polycarbonate resin, an acrylic resin, and a polystyrene resin. Among them, a polycarbonate resin or a polyester resin is preferable. As the polyester resin, a polyarylate resin is particularly preferable.

A content ratio of the charge-transporting substance to the resin is preferably 4:10 to 20:10 and more preferably 5:10 to 12:10.

In addition, the charge-transporting layer may also contain additives such as an antioxidant, an ultraviolet absorber, a plasticizer, a leveling agent, a lubricity imparting agent, and an abrasion resistance improver.

Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

An average thickness of the charge-transporting layer is preferably 5 μm or more and 50 μm or less, more preferably 8 μm or more and 40 μm or less, and particularly preferably 10 μm or more and 30 μm or less.

The charge-transporting layer can be formed by preparing a coating liquid for a charge-transporting layer containing the respective materials and a solvent, forming a coating film thereof, and drying the coating film. Examples of the solvent used in the coating liquid can include an alcohol-based solvent, a ketone-based solvent, an ether-based solvent, an ester-based solvent, and an aromatic hydrocarbon-based solvent. Among these solvents, an ether-based solvent or an aromatic hydrocarbon-based solvent is preferable.

(2) Monolayer Type Photosensitive Layer

The monolayer type photosensitive layer can be formed by preparing a coating liquid for a photosensitive layer containing a charge generating substance, a charge-transporting substance, a resin, and a solvent, forming a coating film of thereof, and drying the coating film. Examples of materials of the charge generating substance, the charge-transporting substance, and the resin are the same as in the "(1) Laminate Type Photosensitive Layer".

<Protective Layer>

The protective layer contains at least a polymer of a composition containing a compound having a polymerizable group.

The protective layer may also contain additives such as an antioxidant, an ultraviolet absorber, a plasticizer, a leveling agent, a lubricity imparting agent, an abrasion resistance improver, and a polymerization reaction initiator.

Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, a boron nitride particle, titanium oxide, zinc oxide, tin oxide, and indium oxide.

In addition, a phenol resin, an epoxy resin, a siloxane resin, or a charge-transporting substance can be added to the protective layer. Examples of the charge-transporting substance can include a triarylamine compound, a hydrazone compound, a stilbene compound, a pyrazoline compound, an oxazole compound, a thiazole compound, and a triallylmethane compound.

Examples of the compound having the polymerizable group used in the protective layer can include a compound having a chain polymerizable functional group such as an acryloyloxy group, a methacryloyloxy group, or a styryl group and a compound having a sequentially polymerizable functional group such as a hydroxyl group, an alkoxysilyl group, or an isocyanate group. In the case of the charge-transporting substance, a polymerizable monomer/oligomer having the above-described charge-transporting substance or a skeleton of the above-described charge-transporting substance is preferably used. Examples thereof can include a compound having a chain polymerizable functional group such as an acryloyloxy group, a methacryloyloxy group, or a styryl group and a charge-transporting substance having a sequentially polymerizable functional group such as a hydroxyl group, an alkoxysilyl group, or an isocyanate group. A compound having both a charge-transporting structure and an acryloyloxy group or a methacryloyloxy group in one molecule is more preferably used from the viewpoint of charge-transporting ability. As the charge-transporting structure, a triphenylamine structure is preferable from the viewpoint of the charge-transporting ability.

As a specific example, a triphenylamine compound having an acryloyloxy group or a methacryloyloxy group is represented by any one of Structural Formula (OCL-1) to Structural Formula (OCL-8).

(OCL-1)

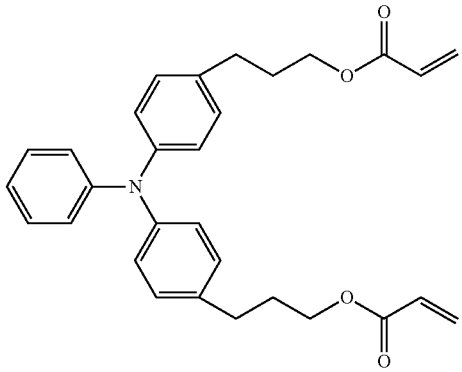

(OCL-2)

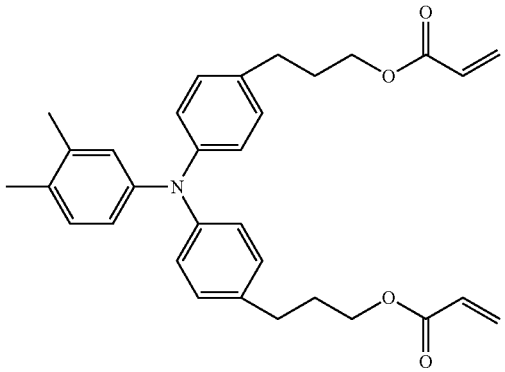

(OCL-3)

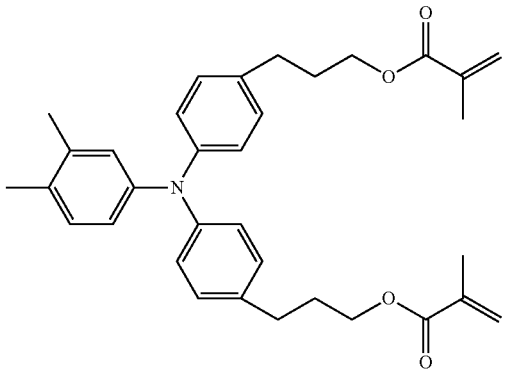

(OCL-4)

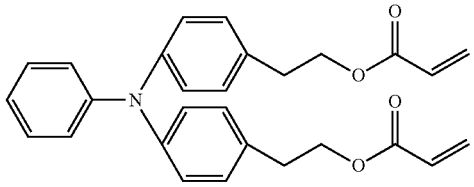

-continued (OCL-5)

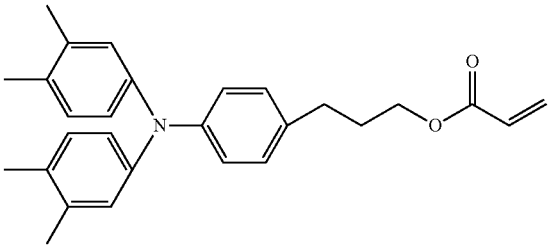

(OCL-6)

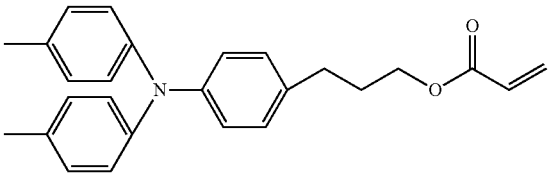

(OCL-7)

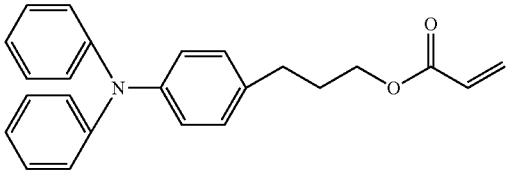

(OCL-8)

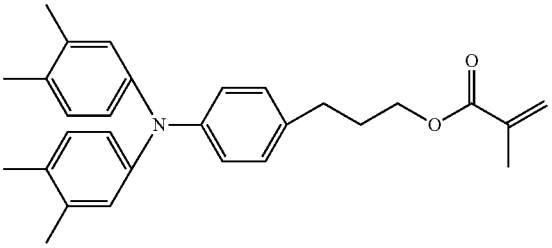

An average thickness of the protective layer is preferably 0.5 μm or more and 10 μm or less, and more preferably 1 μm or more and 7 μm or less.

The protective layer can be formed by preparing a coating liquid for a protective layer containing the respective materials and a solvent, forming a coating film thereof, and curing the coating film. Examples of the solvent used in the coating liquid can include an alcohol-based solvent, a ketone-based solvent, an ether-based solvent, a sulfoxide-based solvent, an ester-based solvent, and an aromatic hydrocarbon-based solvent.

Examples of a polymerization reaction can include a thermal polymerization reaction, a photo-polymerization reaction, and a radiation polymerization reaction.

Furthermore, in order to increase water repellency of the protective layer or to suppress adhesion of a discharge product by charging, it is preferable that the protective layer contains a compound having a siloxane structure or a fluoro group or a polymer of the compound. It is considered that when the protective layer contains a compound having a siloxane structure or a fluoro group having hydrophobicity or a polymer of the compound, infiltration of moisture or the discharge product into the protective layer can be reduced.

When the coating liquid for each layer is applied, an application method such as an immersion coating method (dipping method), a spray coating method, a spinner coating method, a bead coating method, a blade coating method, or a beam coating method can be used.

<Method of Forming Roughness on Protective Layer>

The surface of the protective layer is subjected to a surface processing using a polishing sheet, a shape transfer type member, a glass bead, or a zirconia bead. In addition, irregularities may also be formed on the surface by using a constituent material for the coating liquid.

Figure 4:
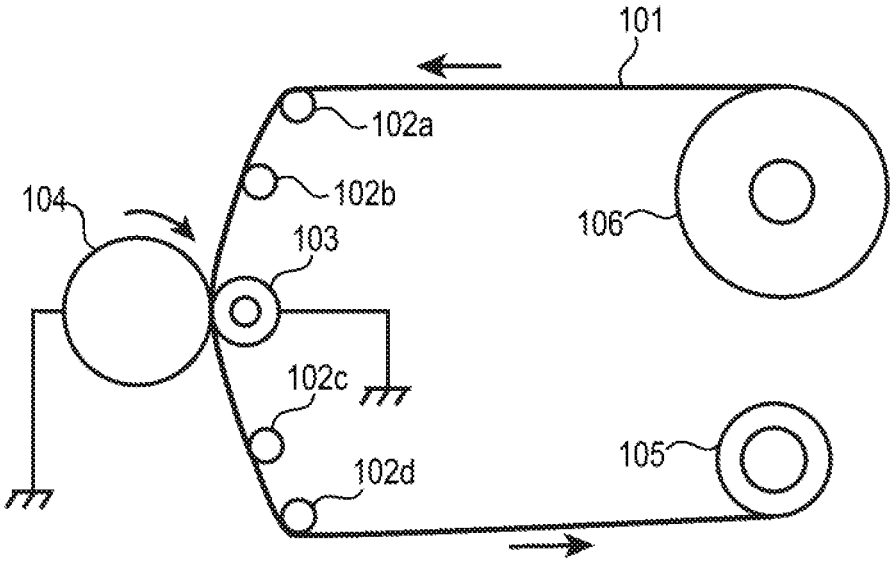
FIG. 4 illustrates an example of a device for polishing an electrophotographic photosensitive member included in the process cartridge according to an embodiment of the present disclosure.

For example, as illustrated in FIG. 4, a polishing sheet 101 is mounted on a cylindrical shaft 106, the polishing sheet 101 is drawn out and mounted on a guide roller 102*a* and a guide roller 102*b*, the polishing sheet 101 is further mounted on a guide roller 102*c* and a guide roller 102*d* via a backup roller 103, and then the polishing sheet 101 is disposed so that it is drawn out to a winding unit 105 and is wound around the winding unit 105. Thereafter, an electrophotographic photosensitive member 104 is mounted, and polishing is performed at desired rotation speeds of the polishing sheet 101 and the electrophotographic photosensitive member 104 using a motor or the like.

<Measurement Method of Surface Roughness of Protective Layer>

In the surface roughness of the protective layer, in order to increase the charge density on the surface of the protective layer, it is required to satisfy that the protruding valley portion Rvk is 0.01 μm or more and 0.10 μm or less and the load length ratio Mr2 is 75% or more and 85% or less.

In addition, Sd/Rvk is required to satisfy 1 or more and 100 or less, and more preferably 5 or more and 80 or less, from the viewpoint of the optimal configuration.

Furthermore, when the average interval Sm of the irregularities of the protective layer is 10 μm or more and 40 μm or less, the photosensitive member can more efficiently receive the charges, such that the charge density can be further increased. Thus, the effect of suppressing the occurrence of the pattern memory can be improved.

Rvk, Mr2, and Sm are measured under the following conditions.

Roughness measuring device: SE3500 (manufactured by Kosaka Laboratory Ltd.)

Cutoff value: 0.08 mm

Preliminary length: cutoff×1

Filter characteristic: 2CR

Evaluation length: 2.5 mm

Longitudinal magnification: 10,000

Lateral magnification: 50

Feed length: 0.1 mm/sec

Leveling: straight line (entire region)

JIS B 0601-1982

Entire evaluation length treatment: equally dividing interval evaluation length into 8,000

λs filter: none

Polarity: normal

The photosensitive member is divided into three regions in a major axis direction, three points in the center of each region are measured, and average values are defined as Rvk, Mr2, and Sm, respectively.

<Adjustment Method of Contact Width between Photosensitive Member and Charging Member>

The contact width can be adjusted by changing hardness or a spring pressure of a member fixed to the charging member.

<Measurement Method of Contact Width between Photosensitive Member and Charging Member>

An example of a measurement method of the contact width includes a method using a carbon pressure sensitive paper.

An example of the measurement method of the contact width using the carbon pressure sensitive paper includes a measurement method in which when a photosensitive member and a charging member are mounted in a process cartridge, a carbon pressure sensitive paper with about 25 μm is sandwiched in a contact portion between the photosensitive member and the charging member, the charging member is divided into five in a longitudinal direction, widths of discolored portions corresponding to the divided locations are measured, and an average of the measured widths is defined as a contact width. After the contact width is measured by the carbon pressure sensitive paper, the photosensitive member and the charging member are once removed from the process cartridge, and the photosensitive member and the charging member are mounted in the process cartridge again.

Process Cartridge and Electrophotographic Apparatus

A process cartridge according to one aspect of the present disclosure includes the electrophotographic photosensitive member and the charging member described above, integrally supports at least one unit selected from the group consisting of a developing unit and a cleaning unit, and is detachably attachable to a main body of an electrophotographic apparatus.

In addition, an electrophotographic apparatus according to one aspect of the present disclosure includes a process cartridge including at least an electrophotographic photosensitive member and a charging member, and at least one selected from the group consisting of an exposing unit, a developing unit, and a transfer unit.

Figure 3:
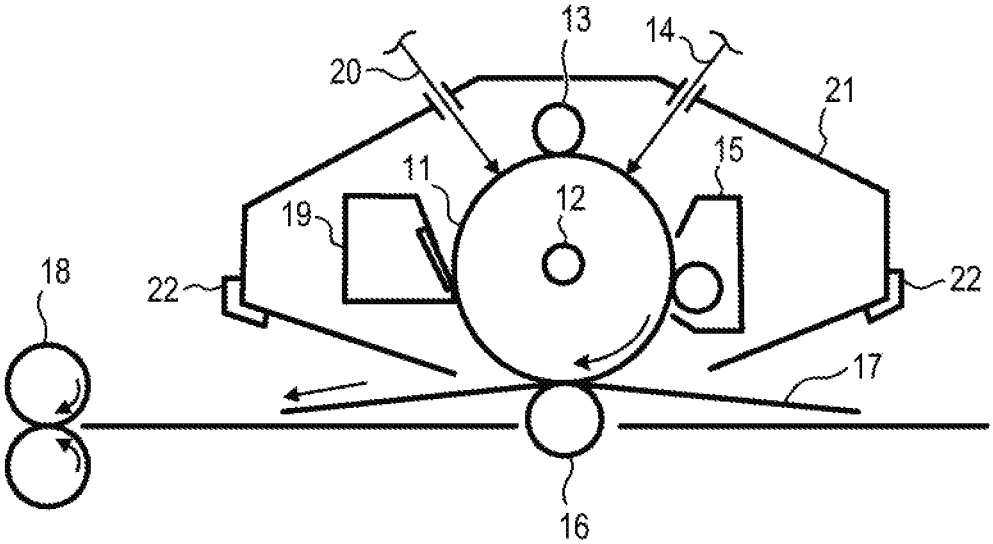
FIG. 3 illustrates an example of a schematic configuration of an electrophotographic apparatus according to an embodiment of the present disclosure.

FIG. 3 illustrates an example of a schematic configuration of a process cartridge 21 and an electrophotographic apparatus including the process cartridge 21.

A cylindrical electrophotographic photosensitive member 11 is rotatably driven about a shaft 12 in the arrow direction at a predetermined peripheral velocity. A surface of the electrophotographic photosensitive member 11 is charged to have a predetermined positive or negative potential by a charging unit 13. In the present embodiment, the charging unit 13 may employ a roller charging manner using a roller type charging member. The surface of the charged electrophotographic photosensitive member 11 is irradiated with exposure light 14 emitted from an exposing unit (not illustrated), and an electrostatic latent image corresponding to target image information is formed on the surface of the electrophotographic photosensitive member 11. The electrostatic latent image formed on the surface of the electrophotographic photosensitive member 11 is developed by supplying a toner stored in a developing unit 15, and a toner image is formed on the surface of the electrophotographic photosensitive member 11. The toner image formed on the surface of the electrophotographic photosensitive member 11 is transferred onto a transfer material 17 by a transfer unit 16. The transfer material 17 onto which the toner image is transferred is conveyed to a fixing unit 18, is subjected to a treatment for fixing the toner image, and is printed out to the outside of the electrophotographic apparatus. The electrophotographic apparatus may also include a cleaning unit 19 for removing attached materials such as the toner remaining on the surface of the electrophotographic photosensitive member 11 after the transfer. The cleaning unit is preferably a cleaning blade formed of a urethane resin. In addition, a so-called cleaner-less system configured to remove the attached materials by the developing unit or the like may be used without separately providing the cleaning unit. The electrophotographic apparatus may also include an antistatic mechanism for an antistatic treatment of the surface of the electrophotographic photosensitive member 11 by pre-exposure light 20 from a pre-exposing unit (not illustrated). In addition, a guiding unit 22 such as a rail may be provided for detachably attaching the process cartridge 21 according to one aspect of the present disclosure to the main body of the electrophotographic apparatus.

The electrophotographic photosensitive member according to one aspect of the present disclosure can be used in, for example, a laser beam printer, an LED printer, a copying machine, a facsimile, and a composite machine thereof.

According to one aspect of the present disclosure, a process cartridge capable of suppressing an occurrence of pattern memory even in a low-temperature and low-humidity environment can be obtained. Further, according to one aspect of the present disclosure, an electrophotographic apparatus capable of forming a high quality electrophotographic image can be obtained.

EXAMPLES

Hereinafter, the process cartridge and the electrophotographic apparatus according to the present disclosure will be described in more detail by using examples and comparative examples. It should be noted that the present disclosure is not limited to a configuration embodied by the following examples. Further, in the description of the following examples, unless otherwise specified, the term "part(s)" is on a mass basis.

<Production of Charging Member 1>

1. Preparation of Unvulcanized Rubber Mixture (CMB) for Domain Formation

The respective materials shown in Table 1 were mixed with each other in mixing amounts shown in Table 1 using a 6-liter pressure kneader (trade name: TD6-15MDX, manufactured by Toshinsha Co., Ltd.), thereby obtaining CMB. The mixing was performed under mixing conditions of a filling rate of 70 vol %, a blade rotation speed of 30 rpm, and a mixing time of 20 minutes.

TABLE 1

| | Raw material name | Mixing amount (parts by mass) |
|---|---|---|
| Raw rubber | Styrene butadiene rubber (trade name: Tufdene 1000, produced by Asahi Kasei Corporation) | 100 |
| Electronic conductive agent | Carbon black (trade name: TOKABLACK #5500, produced by Tokai Carbon Co., Ltd.) | 60 |
| Vulcanization accelerator aid | Zinc oxide (trade name: 2 types of zinc oxide, produced by SAKAI CHEMICAL INDUSTRY CO., LTD.) | 5 |
| Processing aid | Zinc stearate (trade name: SZ-2000, produced by SAKAI CHEMICAL INDUSTRY CO., LTD.) | 2 |

2. Preparation of Rubber Mixture (MRC) for Matrix Formation

The respective materials shown in Table 2 were mixed with each other in mixing amounts shown in Table 2 using a 6-liter pressure kneader (trade name: TD6-15MDX, manufactured by Toshinsha Co., Ltd.), thereby obtaining MRC. The mixing was performed under mixing conditions of a filling rate of 70 vol %, a blade rotation speed of 30 rpm, and a mixing time of 16 minutes.

TABLE 2

| | Raw material name | Mixing amount (parts by mass) |
|---|---|---|
| Raw rubber | Butyl rubber (trade name: JSR Butyl 065, produced by JSR CORPORATION) | 100 |
| Filler | Calcium carbonate (trade name: Nanox #30, produced by MARUO CALCIUM CO., LTD.) | 70 |
| Vulcanization accelerator aid | Zinc oxide (trade name: 2 types of zinc oxide, produced by SAKAI CHEMICAL INDUSTRY CO., LTD.) | 7 |
| Processing aid | Zinc stearate (trade name: SZ-2000, produced by SAKAI CHEMICAL INDUSTRY CO., LTD.) | 2.8 |

3. Preparation of Unvulcanized Rubber Mixture for Conductive Layer Formation

The obtained CMB and MRC were mixed with each other in mixing amounts shown in Table 3 using a 6-liter pressure kneader (trade name: TD6-15MDX, manufactured by Toshinsha Co., Ltd.). The mixing was performed under mixing conditions of a filling rate of 70 vol %, a blade rotation speed of 30 rpm, and a mixing time of 16 minutes.

TABLE 3

| | Raw material name | Mixing amount (parts by mass) |
|---|---|---|
| Raw rubber | Unvulcanized domain rubber composition | 25 |
| Raw rubber | Unvulcanized matrix rubber composition | 75 |

4. Preparation of Rubber Mixture for Conductive Layer Formation

Next, a vulcanizing agent and a vulcanization aid shown in Table 4 were added to 100 parts by mass of an unvulcanized rubber mixture for conductive layer formation in mixing amounts shown in Table 4, and the mixing was performed using an open roll having a roll diameter of 12 inches, thereby preparing a rubber mixture for conductive layer formation. Cut-back at the right and left was performed 20 times in total under mixing conditions of a front-roll rotation speed of 10 rpm, a back-roll rotation speed of 8 rpm, and a roll gap of 2 mm, and tight milling was performed 10 times at a roll gap of 0.5 mm, thereby obtaining a rubber mixture 1 for conductive layer formation. The volume resistivity of the matrix and the volume resistivity of the domain are shown in Table 9.

TABLE 4

| | Raw material name | Mixing amount (parts by mass) |
|---|---|---|
| Vulcanizing agent | Sulfur (trade name: SULFAX PMC, produced by Tsurumi Chemical Industry Co., Ltd.) | 3 |
| Vulcanization aid | Tetramethylthiuram disulfide (trade name: Nocceler TT-P, produced by OUCHI SHINKO CHEMICAL INDUSTRIAL CO., LTD.) | 3 |

5. Production of Charging Member 1

Support Having Conductive Outer Surface

As a support having a conductive outer surface, a round rod having a surface that was formed of stainless steel (SUS304) and was subjected to electroless nickel plating, and having a total length of 252 mm and an outer diameter of 6 mm was prepared.

Formation of Conductive Layer

A die having an inner diameter of 10.0 mm was attached to a tip of a cross head extruder equipped with a mechanism for supplying the support and a mechanism for discharging an unvulcanized rubber roller, temperatures of the extruder and the cross head were set to 80° C., and a conveyance speed of the support was adjusted to 60 mm/sec. Under these conditions, the rubber mixture 1 for conductive layer formation was supplied from the extruder to cover an outer circumferential portion of the support with the rubber mixture 1 for conductive layer formation in the cross head, thereby obtaining an unvulcanized rubber roller.

Next, the unvulcanized rubber roller was put into a hot-air vulcanizing furnace at 160° C. to vulcanize the rubber mixture for conductive layer formation by performing heating for 60 minutes, thereby obtaining a roller having a conductive layer formed on the conductive outer surface of the support. Thereafter, each of both ends of the conductive layer was cut off by 10 mm to set a length of the conductive layer in the longitudinal direction to 232 mm.

Finally, a surface of the conductive layer was polished with a rotary grindstone. By doing so, a crown-shaped charging member 1 having diameters of 8.44 mm at positions corresponding to about 90 mm from the central portion to sides close to the both ends, respectively, and a diameter of 8.5 mm at the central portion was obtained.

<Production of Charging Members 2 to 10>

Charging member 2 to 10 were produced in the same manner as that of the production of the charging member 1, except that an unvulcanized matrix rubber composition and an unvulcanized domain rubber composition shown in Table 8 were prepared by using materials shown in Tables 5 to 7, and rubber compositions for electro-conductive layer formation shown in Table 9 were prepared by using these compositions.

TABLE 5

| Abbreviation of material | Material name | Trade name | Manufacturer name |
|---|---|---|---|
| #7360 | Conductive carbon black | TOKABLACK #7360 SB | Tokai Carbon Co., Ltd. |
| #5500 | Conductive carbon black | TOKABLACK #5500 | Tokai Carbon Co., Ltd. |
| Ketjen | Conductive carbon black | Ketjen black EC600JD | LION SPECIALTY CHEMICALS CO., LTD. |
| LV70 | Quaternary ammonium salt | Adeka cizer LV70 | ADEKA CORPORATION |

TABLE 6

| Abbreviation of material | | Material name | Trade name | Manufacturer name |
|---|---|---|---|---|
| Butyl | JSR Butyl 065 | Butyl rubber | JSR Butyl 065 | JSR CORPORATION |
| ECO | CG102 | Epichlorohydrin rubber | Epichlomer CG102 | OSAKA SODA CO., LTD. |
| EPDM | Esprene301A | Ethylene propylene diene rubber | Esprene301A | Sumitomo Chemical Co., Ltd. |
| EPDM | Esprene505A | Ethylene propylene diene rubber | Esprene505A | Sumitomo Chemical Co., Ltd. |
| NBR | N230SV | Acrylonitrile butadiene rubber | JSR N230SV | JSR CORPORATION |
| NBR | N220S | Acrylonitrile butadiene rubber | JSR N220S | JSR CORPORATION |
| SBR | T2003 | Styrene butadiene rubber | Tufdene 2003 | Asahi Kasei Corporation |
| SBR | T1000 | Styrene butadiene rubber | Tufdene 1000 | Asahi Kasei Corporation |

TABLE 7

| Material (abbreviation) | Material name | Trade name | Manufacturer name |
|---|---|---|---|
| Sulfur | Sulfur | SULFAX PMC | Tsurumi Chemical Industry Co., Ltd. |
| TT | Tetramethylthiuram disulfide | Nocceler TT-P | OUCHI SHINKO CHEMICAL INDUSTRIAL CO., LTD. |
| TBZTD | Tetrabenzylthiuram disulfide | Sanceler TBZTD | SANSHIN CHEMICAL INDUSTRY CO., LTD. |
| TET | Tetraethylthiuram disulfide | Sanceler TETG | SANSHIN CHEMICAL INDUSTRY CO., LTD. |

TABLE 8

| | Unvulcanized matrix rubber composition | | | | | | Unvulcanized domain rubber composition | | |
|---|---|---|---|---|---|---|---|---|---|
| | Raw rubber type | | | Additive | | | Raw rubber type | | |
| Charging member | First rubber in matrix | SP value | Mooney viscosity | Abbreviation of material | Parts by mass | Mooney viscosity | Second rubber in matrix | SP value | Mooney viscosity |
| Charging member 1 | Butyl JSR065 | 15.8 | 32 | | | 40 | SBR T1000 | 16.8 | 45 |
| Charging member 2 | EPDM Esprene505A | 16 | 47 | | | 52 | NBR N230SV | 19.2 | 32 |
| Charging member 3 | Butyl JSR065 | 15.8 | 32 | | | 40 | EPDM Esprene505A | 16 | 47 |
| Charging member 4 | EPDM Esprene505A | 16 | 47 | | | 52 | NBR N230SV | 19.2 | 32 |
| Charging member 5 | SBR T2003 | 17 | 33 | #7360 | 30 | 68 | NBR N230SV | 19.2 | 32 |
| Charging member 6 | EPDM Esprene505A | 16 | 47 | | | 52 | NBR N220S | 20.4 | 57 |
| Charging member 7 | Butyl JSR065 | 15.8 | 32 | | | 40 | EPDM Esprene301A | 16 | 47 |
| Charging member 8 | EPDM Esprene505A | 16 | 47 | | | 52 | NBR N220S | 20.4 | 57 |
| Charging member 9 | SBR T2003 | 17 | 33 | | | 38 | NBR N230SV | 19.2 | 32 |
| Charging member 10 | ECO CG102 | 18.5 | 52 | LV | 3 | 40 | NBR N230SV | 19.2 | 32 |

| | Unvulcanized domain rubber composition | | | | |
|---|---|---|---|---|---|
| | Conductive agent | | | | |
| Charging member | Electronic conductive agent | Parts by mass | DBP | Dispersion time min | Mooney viscosity |
| Charging member 1 | CB #5500 | 60 | 155 | 20 | 92 |
| Charging member 2 | CB #7360 | 70 | 87 | 20 | 90 |
| Charging member 3 | CB #5500 | 65 | 155 | 20 | 94 |
| Charging member 4 | CB #7360 | 70 | 87 | 20 | 90 |
| Charging member 5 | CB #7360 | 70 | 87 | 20 | 90 |
| Charging member 6 | CB #7360 | 70 | 87 | 20 | 90 |
| Charging member 7 | CB #5500 | 65 | 155 | 20 | 92 |

TABLE 8-continued

| | | | | | |
|---|---|---|---|---|---|
| Charging member 8 | CB #7360 | 60 | 87 | 20 | 86 |
| Charging member 9 | CB #7360 | 70 | 87 | 20 | 90 |
| Charging member 10 | Ketjen B EC600JD | 15 | 360 | 20 | 60 |

Regarding the Mooney viscosity shown in Table 8, a value of the raw rubber is a catalog value of each manufacturer. In addition, a value of the unvulcanized domain rubber composition is a Mooney viscosity ML (1+4) based on JIS K6300-1:2013, and is a value measured at a rubber temperature when kneading all materials constituting the CMB.

TABLE 9

| | Rubber mixture for conductive layer formation | | | | | | | |
|---|---|---|---|---|---|---|---|---|
| | Unvulcanized rubber composition | | Unvulcanized rubber dispersion | | Vulcanizing agent | | Vulcanization accelerator | |
| Charging member | Domain parts by mass | Matrix parts by mass | Rotation speed rpm | Kneading time min | Abbreviation of material | Parts by mass | Abbreviation of material | Parts by mass |
| Charging member 1 | 25 | 75 | 30 | 16 | Sulfur | 3 | TT | 3 |
| Charging member 2 | 25 | 75 | 30 | 16 | Sulfur | 3 | TET | 3 |
| Charging member 3 | 25 | 75 | 30 | 16 | Sulfur | 3 | TT | 3 |
| Charging member 4 | 25 | 75 | 30 | 16 | Sulfur | 3 | TET | 3 |
| Charging member 5 | 25 | 75 | 30 | 16 | Sulfur | 3 | TBZTD | 1 |
| Charging member 6 | 25 | 75 | 30 | 16 | Sulfur | 3 | TET | 3 |
| Charging member 7 | 25 | 75 | 30 | 16 | Sulfur | 3 | TET | 3 |
| Charging member 8 | 25 | 75 | 15 | 5 | Sulfur | 3 | TET | 3 |
| Charging member 9 | 25 | 75 | 30 | 16 | Sulfur | 3 | TBZTD | 1 |
| Charging member 10 | 25 | 75 | 30 | 16 | Sulfur | 3 | TBZTD | 1 |

| | Rubber mixture for conductive layer formation | | | | | |
|---|---|---|---|---|---|---|
| | Electrical characteristics | | | Fine structure | | |
| Charging member | Volume resistivity Rcm of matrix | Volume resistivity Rcd of domain | Rcm/Rcd | Sea-island structure | Circle equivalent diameter Sd of domain | Distance Dms between wall surfaces of domains |
| Charging member 1 | $7.13 \times 10^{16}$ | $2.59 \times 10^{01}$ | $2.75 \times 10^{15}$ | Presence | 0.22 | 0.21 |
| Charging member 2 | $8.08 \times 10^{15}$ | $7.03 \times 10^{01}$ | $1.15 \times 10^{14}$ | Presence | 4.90 | 5.10 |
| Charging member 3 | $7.16 \times 10^{16}$ | $2.59 \times 10^{01}$ | $2.76 \times 10^{15}$ | Presence | 0.26 | 0.17 |
| Charging member 4 | $6.27 \times 10^{15}$ | $5.76 \times 10^{01}$ | $1.09 \times 10^{14}$ | Presence | 4.23 | 6.10 |
| Charging member 5 | $1.87 \times 10^{07}$ | $2.55 \times 10^{01}$ | $7.32 \times 10^{05}$ | Presence | 2.20 | 2.30 |
| Charging member 6 | $6.27 \times 10^{15}$ | $5.76 \times 10^{01}$ | $1.09 \times 10^{14}$ | Presence | 4.93 | 5.60 |
| Charging member 7 | $7.16 \times 10^{16}$ | $2.59 \times 10^{01}$ | $2.76 \times 10^{15}$ | Presence | 0.09 | 0.20 |
| Charging member 8 | $6.21 \times 10^{15}$ | $5.87 \times 10^{01}$ | $1.06 \times 10^{14}$ | Presence | 6.80 | 5.65 |
| Charging member 9 | $2.11 \times 10^{12}$ | $3.22 \times 10^{01}$ | $6.55 \times 10^{10}$ | Presence | 2.01 | 2.22 |
| Charging member 10 | $1.44 \times 10^{07}$ | $2.40 \times 10^{02}$ | $5.99 \times 10^{04}$ | Presence | 1.32 | 1.25 |

<Evaluation>

[1] Confirmation of Domain-Matrix Structure

The presence or absence of the formation of the domain-matrix structure in the conductive layer was confirmed by the following method.

A piece (thickness of 500 μm) was cut out using a razor so that a cross section orthogonal to the longitudinal direction of the conductive layer of the charging member was observed. In addition, a piece was also cut out so that the outer surface of the charging member was observed. Next, platinum vapor deposition was performed on each piece, and an image of the piece was captured with a scanning electron microscope (SEM) (trade name: S-4800, manufactured by Hitachi High-Technologies Corporation) at a magnification of 1,000, thereby obtaining a cross section image.

In the example, as illustrated in FIG. 2, the domain-matrix structure observed in the piece cut out from the conductive layer showed a form in which the plurality of domains 3*b* were dispersed in the matrix 3*a* and the domains were present independently of each other without being in contact with each other in the cross section image. Meanwhile, the matrix was in a continuous state in the image and the domain was separated by the matrix.

In order to quantify the captured cross section image, a 256 grayscale monochrome image of the cross section image obtained by the observation with the SEM was obtained by performing 8-bits grayscale using image processing software (trade name: ImageProPlus, manufactured by Media Cybernetics, Inc.). Next, a white and black image inversion processing was performed so that the domain in the cross section became white, and a binarization threshold was set based on the algorithm of Otsu's discrimination analysis method for a luminance distribution of the image, and then the binarized image was obtained.

By a function of counting the binarized image, as described above, a percent K of the number of domains that were not connected to each other and isolated with respect to the total number of domains that were present in the region having the 50 μm square and did not have a contact point with a frame of the binarized image was calculated.

Specifically, the counting function of the image processing software was set so that domains having the contact point in a frame line at end portions of the binarized image in four directions were not counted.

Pieces were prepared from 20 points in total, the 20 points being obtained from arbitrary one point of each of regions obtained by evenly dividing the conductive layer of the charging member into five in a longitudinal direction, and evenly dividing the conductive layer into four in a circumferential direction, and then an arithmetic mean value (number %) of K when performing the measurement was calculated.

When the arithmetic mean value (number %) of K was 80 or more, the domain-matrix structure was evaluated as "presence", and when the arithmetic mean value (number %) of K was less than 80, the domain-matrix structure was determined as "absence". In the present disclosure, the arithmetic mean value (number %) of K of the piece of the cross section orthogonal to the longitudinal direction and the arithmetic mean value (number %) of K of the piece on which the outer surface was observed were the same as each other.

[2] Measurement of Volume Resistivity Rcm of Matrix

The volume resistivity Rcm of the matrix included in the conductive layer was measured as follows.

A scanning probe microscope (SPM) (trade name: Q-Scope 250, manufactured by Quesant Instrument Corporation) was operated in a contact mode.

First, an ultra thin piece having a thickness of 1 μm was cut out from the conductive layer of the charging member at a cutting temperature of −100° C. using a microtome (trade name: Leica EM FCS, manufactured by Leica Microsystems).

The ultra thin piece was cut out in a direction of the cross section perpendicular to the longitudinal direction of the charging member based on the direction in which the charges for discharge were transported.

Next, under an environment of a temperature of 23° C. and a humidity of 50% RH, the ultra thin piece was disposed on a metal plate, a portion directly in contact with the metal plate was selected, and a cantilever of the SPM was brought into contact with a portion corresponding to the matrix. Subsequently, a voltage of 50 V was applied to the cantilever for 5 seconds, a current value was measured, and an arithmetic mean value for 5 seconds was calculated.

A surface shape of the measurement piece was observed with the SPM, and a thickness of the measurement portion was calculated from the obtained height profile. In addition, a concave area of the contact portion with the cantilever was calculated from the observation result of the surface shape. A volume resistivity was calculated from the thickness and the concave area, and was defined as a volume resistivity of the matrix.

The measurement was performed by preparing the pieces obtained from 20 points in total, the 20 points being obtained from arbitrary one point of each of regions obtained by evenly dividing the conductive layer of the charging member into five in the longitudinal direction and evenly dividing the conductive layer into four in the circumferential direction. An arithmetic mean value of the 20 points was defined as a volume resistivity Rcm of the matrix.

The evaluation results are shown in Table 9 as "Volume resistivity Rcm" of the matrix.

[3] Measurement of Volume Resistivity Rcd of Domain

The volume resistivity Rcd of the domain was measured in the same method as that of the measurement of the volume resistivity Rcm of the matrix, except that the measurement was performed at the locations corresponding to the domains in the ultra thin piece and the measurement voltage was set to 1 V. The evaluation results are shown in Table 9 as "Volume resistivity Rcd" of the domain.

[4] Measurement of Average Value Sd of Circle Equivalent Diameters of Domains Observed on Outer Surface of Conductive Layer The average value Sd of the circle equivalent diameters of the domains was measured as follows.

When a length of the conductive layer in the longitudinal direction was defined as L, samples including the outer surface of the conductive layer were cut out from three portions located at the center of the conductive layer in the longitudinal direction and at two portions corresponding to L/4 from both ends of the conductive layer to the center of the conductive layer, respectively, using a microtome (trade name: Leica EM FCS, manufactured by Leica Microsystems). A thickness of the sample is set to 1 μm.

A surface of the sample corresponding to the outer surface of the conductive layer is subjected to vapor deposition of platinum. Any three portions on each of the platinum vapor deposited surfaces of the samples were selected and images thereof were captured with a scanning electron microscope (SEM) (trade name: S-4800, manufactured by Hitachi High-Technologies Corporation) at a magnification of 5,000. Each of the nine captured images was binarized using image processing software (trade name: ImageProPlus, manufactured by Media Cybernetics, Inc.), the binarized images were quantified by a counting function, and the arithmetic mean value Ss of the plane areas of the domains included in each of the capture images was calculated. Next, the circle equivalent diameters ($=(4S/\pi)^{0.5}$) of the domains are calculated from the arithmetic mean value Ss of the plane areas of the domains calculated from each of the captured images. Next, an arithmetic mean value of the circle equivalent diameters of the domains in each of the captured images was calculated, and then, when the outer surface of the conductive layer which was an object to be measured was observed, the average value Sd of the circle equivalent diameters of the domains was obtained. The evaluation results are shown in Table 9 as "Circle equivalent diameter Sd".

[5] Measurement of Average Value Dms of Distances between Wall Surfaces of Domains on Outer Surface of Conductive Layer When a length of the conductive layer of the charging member in the longitudinal direction was defined as L, samples were cut out from three portions located at the center of the conductive layer in the longitudinal direction and at two portions corresponding to L/4 from the both ends of the conductive layer to the center of the conductive layer, respectively, using a razor so that the outer surface of the charging member was included in the sample. A size of the sample was 2 mm in the circumferential direction and the longitudinal direction of the conductive layer, and a thickness of the conductive layer was 1 mm.

In each of the obtained three samples, analysis regions each having a 50 μm square were set at arbitrary three portions of a surface corresponding to the outer surface of the conductive layer, and images of the three analysis regions were captured with a scanning electron microscope (product name: S-4800, manufactured by Hitachi High-Technologies Corporation) at a magnification of 5,000. The obtained nine captured images in total were binarized using image processing software (product name: LUZEX, manufactured by NIRECO CORPORATION).

The obtained nine captured images in total were binarized using image processing software (product name: LUZEX, manufactured by NIRECO CORPORATION). The binarization procedure was performed as follows. A 256 grayscale monochrome image of each of the captured images was obtained by performing 8-bits grayscale. Then, a white and black image inversion processing was performed, binarization was performed, and a binarized image of the captured image was obtained so that the domain in the captured image became white. Next, for each of the nine binarized images, a distance between the wall surfaces of the domains was calculated, and an arithmetic mean value thereof was calculated. In addition, an average value of the distances between the wall surfaces of the domains obtained from the nine images for evaluation was calculated and defined as an average value Dms of the distances between the wall surfaces of the domains. The evaluation results are shown as "Average value Dms of distances between wall surfaces of domains on outer surface" of the matrix.

The evaluation results are shown in Table 9 as "Average value Dms of distances between wall surfaces" of the domains.

[6] Measurement Method of SP Value

An SP value was calculated by preparing a calibration curve using a material of which an SP value was known. As the known SP value, a catalog value of a raw material manufacturer was used. A content ratio of acrylonitrile or styrene in the rubber constituting the matrix and the domain was analyzed using pyrolysis gas chromatography (Py-GC) and solid NMR, and the SP value was calculated from the calibration curve obtained from the material of which the SP value was known. In addition, an SP value of isoprene rubber was determined in a 1,2-polyisoprene, 1,3-polyisoprene, 3,4-polyisoprene, cis-1,4-polyisoprene, or trans-1,4-polyisoprene isomeric structure. Therefore, similarly to SBR and NBR, the SP value was calculated from the material of which the SP value was known by analyzing a content ratio of the isomer by Py-GC and solid NMR.

[7] Measurement Method of Mooney Viscosity ML (1+4)

As a viscosity of each of a rubber mixture for domain formation or a rubber mixture for matrix formation, a Mooney viscosity ML (1+4) was measured at a rubber temperature when kneading the mixture based on JIS K 6300-1:2013.

<Production of Electrophotographic Photosensitive Member>

An aluminum cylinder (JIS-A3003, aluminum alloy) having a diameter of 24 mm and a length of 257.5 mm was used as a support.

Next, 214 parts of a titanium oxide ($TiO_2$) particle (average primary particle diameter: 230 nm) coated with oxygen deficiency tin oxide ($SnO_2$) as a metal oxide particle, 132 parts of a phenol resin (a monomer/oligomer of the phenol resin) (trade name: Plyophen J-325, produced by Dainippon Ink and Chemicals Inc., resin solid content: 60% by mass) as a binding material, and 98 parts of 1-methoxy-2-propanol as a solvent were placed in a sand mill using 450 parts of glass beads having a diameter of 0.8 mm, and a dispersion treatment was performed under conditions of a rotation speed of 2,000 rpm, a dispersion treatment time of 4.5 hours, and a cooling water set temperature of 18° C., thereby obtaining a dispersion. The glass beads were removed from the dispersion with a mesh (opening: 150 μm).

Thereafter, a surface roughening material was added to the dispersion so that a content thereof was 10% by mass with respect to a total mass of the metal oxide particle and the binding material in the dispersion. A silicone resin particle (trade name: Tospearl 120, produced by Momentive Performance Materials Inc., average particle diameter: 2 μm) was used as the surface roughening material. In addition, silicone oil (trade name: SH28PA, produced by Dow Corning Toray Co., Ltd.) as a leveling agent was added to the dispersion so that a content of the silicone oil was 0.01% by mass with respect to the total mass of the metal oxide particle and the binding material in the dispersion.

Next, a solvent in which methanol and 1-methoxy-2-propanol (mass ratio: 1:1) were mixed with each other was added to the dispersion so that a total mass (that is, a solid content mass) of the metal oxide particle, the binding material, and the surface roughening material in the dispersion was 67% by mass with respect to a mass of the dispersion. A coating liquid for a conductive layer was prepared by stirring the mixture.

The coating liquid for a conductive layer was applied onto the support by dip coating, and heating was performed at 140° C. for 1 hour, thereby forming a conductive layer having a thickness of 30 μm.

100 parts of a rutile-type titanium oxide particle (trade name: MT-600B, average primary particle diameter: 50 nm, produced by TAYCA Corporation) were mixed with 500 parts of toluene by stirring, 4.5 parts of vinyltrimethoxysilane (trade name: KBM-1003, produced by Shin-Etsu Chemical Co., Ltd.) was added thereto, and the mixture was stirred for 8 hours. Thereafter, the toluene was removed by distillation under reduced pressure and dried at 120° C. for 3 hours, thereby obtaining a rutile-type titanium oxide particle subjected to a surface treatment with vinyltrimethoxysilane.

18 parts of the rutile-type titanium oxide particle subjected to the surface treatment with vinyltrimethoxysilane, 4.5 parts of N-methoxymethylated nylon (trade name: Toresin EF-30T, produced by Nagase ChemteX Corporation), and 1.5 parts of a copolymer nylon resin (trade name: Amilan CM8000, produced by Toray Co., Ltd.) were added to a solvent in which 90 parts of methanol and 60 parts of 1-butanol were mixed with each other, thereby preparing a dispersion. The dispersion was dispersed by using glass beads having a diameter of 1.0 mm with a vertical sand mill for 5 hours, thereby preparing a coating liquid for an undercoat layer. The coating liquid for an undercoat layer was applied onto the conductive layer by dip coating to form a coating film, and the obtained coating film was dried at 100° C. for 10 minutes, thereby forming an undercoat layer having a thickness of 2.0 μm.

10 parts of crystalline hydroxygallium phthalocyanine having peaks at positions of 7.5° and 28.4° in a chart obtained by CuKα characteristic X-ray diffraction and 5 parts of a polyvinyl butyral resin (trade name: S-LEC BX-1, produced by Sekisui Chemical Co., Ltd.) were added to 200 parts of cyclohexane, and the mixture was dispersed with a sand mill device using glass beads having a diameter of 0.9 mm for 6 hours.

150 parts of cyclohexanone and 350 parts of ethyl acetate were further added thereto and diluted, thereby obtaining a coating liquid for a charge-generating layer. The obtained coating liquid for a charge-generating layer was applied onto the undercoat layer by dip coating to form a coating film, and then the coating film was dried at 95° C. for 10 minutes, thereby forming a charge-generating layer having a thickness of 0.20 μm.

Measurement of X-ray diffraction was performed under the following conditions.

[Powder X-Ray Diffraction Measurement]

Used measuring machine: X-ray diffractometer RINT-TTRII, manufactured by Rigaku Corporation X-ray tube bulb: Cu Tube voltage: 50 KV Tube current: 300 mA Scanning method: 2θ/θ scan Scanning rate: 4.0°/min Sampling interval: 0.02°

Start angle (2θ): 5.0°

Stop angle (2θ): 40.0°

Attachment: standard sample holder

Filter: not used

Incident monochrome: used

Counter monochromator: not used

Divergence slit: open

Divergence longitudinal restriction slit: 10.00 mm

Scattering slit: open

Light-receiving slit: open

Flat monochromator: used

Counter: scintillation counter 5 parts of a charge-transporting substance represented by Structural Formula C-2, 5 parts of a charge-transporting substance represented by Structural Formula C-3, 10 parts of polycarbonate (trade name: IUPILON 2400, produced by Mitsubishi Engineering-Plastics Corporation), and 0.02 parts of polycarbonate resins having a structure represented by Formula D-1 and a structure represented by Formula D-2, respectively, (x/y=0.95/0.05, a viscosity-average molecular weight=20,000) were dissolved in a solvent in which 25 parts of orthoxylene, 25 parts of methyl benzoate, and 25 parts of dimethoxymethane were mixed with each other, thereby preparing a coating liquid for a charge-transporting layer. The coating liquid for a charge-transporting layer was applied onto the charge-generating layer by dip coating to form a coating film, and the obtained coating film was dried at 125° C. for 30 minutes, thereby forming a charge-transporting layer having a thickness of 18 μm.

D-1

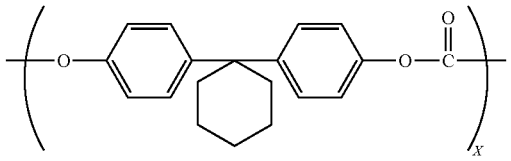

D-2

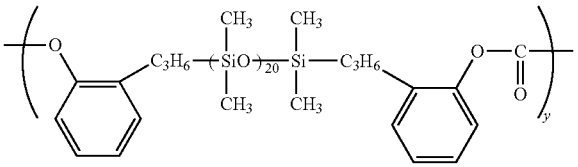

(Preparation of Coating Liquid for Protective Layer)

Preparation of Coating Liquid 1 for Protective Layer 21.7 parts of a compound represented by Structural Formula OCL-6, 9.3 parts of a compound represented by Structural Formula OCL-2, and 0.2 parts of a siloxane-modified acrylic compound (trade name: BYK-3550, produced by BYK-Chemie Japan) were mixed with a solvent in which 20.7 parts of 1-propanol and 48.3 parts of cyclohexane were contained, and the mixture was stirred, thereby preparing a coating liquid 1 for a protective layer.

(Preparation of Coating Liquid 2 for Protective Layer)

30 parts of a compound represented by Structural Formula OCL-2, 10 parts of a silica fine particle (trade name: QSG-100, produced by Shin-Etsu Chemical Co., Ltd.), 0.2 parts of a siloxane-modified acrylic compound (trade name: BYK-3550, produced by BYK-Chemie Japan) were mixed with a solvent in which 72 parts of 2-propanol and 8 parts of tetrahydrofuran were mixed with each other, and the mixture was stirred, thereby preparing a coating liquid 2 for a protective layer.

(Preparation of Coating Liquid 3 for Protective Layer)

10 parts of a compound represented by Structural Formula OCL-1, 2.5 parts of a compound represented by Structural Formula (L-1), 1 part of 1-hydroxycyclohexyl phenyl ketone represented by Structural Formula (I), 0.2 parts of a siloxane-modified acrylic compound (trade name: BYK-3550, produced by BYK-Chemie Japan) were mixed with a solvent in which 72 parts of 2-propanol and 8 parts of tetrahydrofuran were mixed with each other, and the mixture was stirred, thereby preparing a coating liquid 3 for a protective layer.

L-1

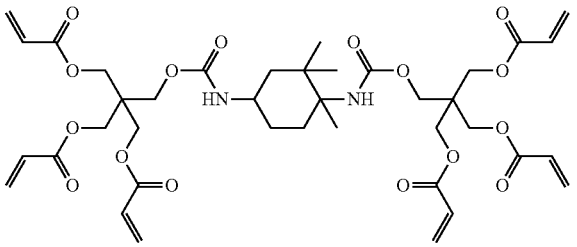

I

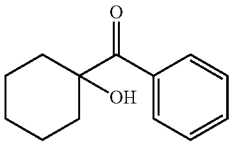

(Preparation of Coating Liquid 4 for Protective Layer)

30 parts of a phenol resin (a monomer/oligomer of the phenol resin) (trade name: Plyophen J-325, produced by Dainippon Ink and Chemicals Inc., resin solid content: 60% by mass) and 0.2 parts of a siloxane-modified acrylic compound (trade name: SYMAC US-270, produced by TOAGOSEI CO., LTD.) were mixed with a solvent in which 15.7 parts of 1-methoxy-2-propanol and 43.3 parts of cyclohexane were contained, and the mixture was stirred, thereby preparing a coating liquid 4 for a protective layer.

(Production Method of Protective Layer)

Production Method 1 of Protective Layer

The coating liquid for a protective layer was applied onto the charge-transporting layer by dip coating to form a coating film, and the obtained coating film was dried at 40° C. for 5 minutes. Thereafter, the coating film was irradiated with electron beams for 1.6 seconds in a nitrogen atmosphere while rotating an object to be irradiated at a speed of 300 Rpm under conditions of an acceleration voltage of 57 kV and a beam current of 5.0 mA. A dose at a surface position was 15 kGy. Thereafter, the temperature of the coating film was increased to 117° C. under a nitrogen atmosphere. An oxygen concentration from electron beam irradiation to the subsequent heat treatment was 10 ppm. Next, the coating film was naturally cooled in the atmospheric air until the temperature of the coating film was 25° C., and then the coating film was subjected to a heat treatment under a condition in which the temperature of the coating film was increased to 120° C. for 30 minutes, thereby forming a protective layer having a thickness of 1.5 μm.

Production Method 2 of Protective Layer

The coating liquid for a protective layer was applied onto the charge-transporting layer by dip coating to form a coating film, and the obtained coating film was dried at 50° C. for 6 minutes. Thereafter, the coating film was irradiated with ultraviolet rays for 10 seconds using an electrodeless lamp "H BULB" (manufactured by Heraeus K.K.) while rotating the object to be irradiated at a speed of 300 Rpm under a condition of a lamp intensity of 0.6 W/cm$^2$. Next, the coating film was naturally cooled until the temperature of the coating film was 25° C., and then the coating film was subjected to a heat treatment under a condition in which the temperature of the coating film was increased to 125° C. for 30 minutes, thereby forming a protective layer having a thickness of 1.5 μm.

Production Method 3 of Protective Layer

A coating liquid for a protective layer was applied onto the charge-transporting layer by dip coating to form a coating film, and the obtained coating film was subjected to a heat treatment at 145° C. for 30 minutes, thereby forming a protective layer having a thickness of 1.5 μm.

<Method of Forming Roughness on Protective Layer>

A sheet-like rubbing member (rubbing sheet) shown in Table 10 was brought into press-contact with a surface of the produced electrophotographic photosensitive member using a device illustrated in FIG. 4. Thereafter, rubbing of the protective layer was performed by moving the rubbing sheet with respect to the surface of the electrophotographic photosensitive member over the time shown in Table 10 to form roughness on the protective layer, thereby producing an electrophotographic photosensitive member. The rubbing conditions are as follows. Rvk, Mr2, and Sm of the protective layer of the produced electrophotographic photosensitive member were as shown in Table 10. In the rubbing sheet shown in Table 10, "#4000" refers to GC #4000 manufactured by Ref-lite, "#3000" refers to GC #3000 manufactured by Ref-lite, and "#2800" refers to GC #2800 manufactured by Ref-lite.

Rubbing sheet: trade name: GC #4000 (manufactured by Ref-lite)

Rubbing sheet feed speed: 500 mm/sec

Rotation speed of electrophotographic photosensitive member: 150 rpm

Intrusion amount of rubbing sheet: 1.7 mm

Measurement Method of Surface Roughness of Protective Layer

Rvk, Mr2, and Sm are measured under the following conditions.

Roughness measuring device: SE3500 (manufactured by Kosaka Laboratory Ltd.)

Cutoff value: 0.08 mm

Preliminary length: cutoff×1

Filter characteristic: 2CR

Evaluation length: 2.5 mm

Longitudinal magnification: 10,000

Lateral magnification: 50

Feed length: 0.1 mm/sec

Leveling: straight line (entire region)

JIS B 0601-1982

Entire evaluation length treatment: dividing interval evaluation length into 8,000

λs filter: none

Polarity: normal

The photosensitive member is divided into three regions in a major axis direction, three points in the center of each region are measured, and average values are defined as Rvk, Mr2, and Sm, respectively.

<Measurement Method of Contact Width between Photosensitive Member and Charging Member>

A contact width was measured by a method using a carbon pressure sensitive paper as follows.

When a photosensitive member and a charging member were mounted in a process cartridge, a carbon pressure sensitive paper with about 25 μm was sandwiched in a contact portion between the photosensitive member and the charging member, the charging member was divided into five in a longitudinal direction, widths of discolored portions corresponding to the divided locations were measured, and an average of the measured widths was defined as a contact width. In a case where the contact width was changed after the measurement of the contact width by using the carbon pressure sensitive paper, a desired contact width in each of the examples and the comparative examples was obtained by changing hardness or a spring pressure of a member supporting the charging member. The contact width was measured, the photosensitive member and the charging member were removed, the photosensitive member and the charging member were mounted in the process cartridge again, and other evaluations were performed.

Example 1

The above-described methods were applied up to a process of producing a charge-transporting layer of a photosensitive member. Thereafter, a protective layer was produced by the production method 1 of the protective layer by using the coating liquid 1 for a protective layer shown in Table 10 on the charge-transporting layer, and roughness was formed on the protective layer with the rubbing sheet and the polishing time shown in Table 10, thereby producing a photosensitive member.

As an electrophotographic apparatus, a laser beam printer (trade name: modified HP Color LaserJet EnterpriseM653dn, manufactured by The Hewlett-Packard Company) was used. In the electrophotographic apparatus used for the evaluation, an image exposure amount, the amount of current flowing from a charging roller to a support of an electrophotographic photosensitive member (hereinafter, referred to as a "total current"), and a voltage applied to a charging member 1 were modified to be adjusted and measured.

First, the electrophotographic apparatus, the charging member 1, and the produced electrophotographic photosensitive member were left in an environment of a temperature of 15° C. and a humidity of 10% RH for 24 hours or longer and then were mounted in a cyan color cartridge of the electrophotographic apparatus.

Next, an application voltage was set to −500 V, a solid image output was performed with a single cyan color on an A4 size plain paper, and an image exposure light amount was set using a spectrophotometer (trade name: X-Rite 504, manufactured by X-Rite, Incorporated) so that a density on the paper was 1.45.

Next, five images having a width of 10 mm and a length of 285 mm were continuously output with the single cyan color to a part of the A4 size paper (an image perpendicular to a cylindrical axial direction of the photosensitive member). Subsequently, it was evaluated that when five halftone images were output with a single cyan color, whether blanks were generated in the previously output images having the width of 10 mm and the length of 285 mm.

Evaluation ranks were as follows. The results are shown in Table 10.

A: No ghost is observed in the $1^{st}$ halftone image.

B: Ghost is slightly observed in the $1^{st}$ halftone image, but disappears in the $2^{nd}$ halftone image.

C: Ghost is slightly observed in the $1^{st}$ and $2^{nd}$ halftone images, but disappears in the $3^{rd}$ halftone image.

D: Ghost is slightly observed in the $1^{st}$ to $3^{rd}$ halftone images, but disappears in the $4^{th}$ halftone image.

E: A thin vertical line ghost with an apparent density is observed in all of the five halftone images, and the density of the ghost is decreased in the $6^{th}$ halftone image.

F: A thin vertical line ghost with an apparent density is observed in all of the six halftone images.

In addition, the cartridge was modified so that a surface potential of the photosensitive member was measured. Specifically, a developing machine was removed, and a potential probe (trade name: model 6000B-8, manufactured by Trek Japan) was mounted at a developing position. Thereafter, a potential at the central portion (position corresponding to about 120 mm distant from an edge of the support) of the electrophotographic photosensitive member was measured using a surface potential meter (trade name: model 344, manufactured by Trek Japan). A drum of the present disclosure was mounted, and a difference of absolute values of a surface potential V1 of the $1^{st}$ rotation of the drum and a surface potential V2 of the $2^{nd}$ rotation of the drum was defined as ΔV. When ΔV is large, a concentration difference of a toner is generated, and the pattern memory tends to be prominent.

Examples 2 to 14 and Comparative Examples 1 to 8

A protective layer was produced with the charging member shown in Table 10, the coating liquid for a protective layer shown in Table 10, and the production method of the protective layer, and the evaluation was carried out in the same manner as that of Example 1 using the photosensitive member produced by forming roughness on the protective layer with the rubbing sheet and the polishing time shown in Table 10. The results are shown in Table 10.

TABLE 10

| Example | Charging member | Contact width (μm) | Circle equivalent diameter Sd (μm) | Sd/Rvk | Distance Dms between wall surfaces of domains (μm) | Coating liquid for protective layer | Production of protective layer | Formation of roughness | Rubbing sheet |
|---|---|---|---|---|---|---|---|---|---|
| Example 1 | Charging member 1 | 600 | 0.22 | 11.0 | 0.21 | 1 | 1 | 1 | #4000 |
| Example 2 | Charging member 1 | 600 | 0.22 | 11.0 | 0.21 | 1 | 1 | 2 | #2800 |
| Example 3 | Charging member 1 | 600 | 0.22 | 4.4 | 0.21 | 1 | 1 | 2 | #2800 |
| Example 4 | Charging member 2 | 600 | 4.9 | 79.0 | 5.10 | 1 | 1 | 2 | #2800 |
| Example 5 | Charging member 1 | 600 | 0.22 | 11.0 | 0.21 | 1 | 1 | 3 | #3000 |
| Example 6 | Charging member 1 | 600 | 0.22 | 20.0 | 0.21 | 1 | 1 | 1 | #4000 |
| Example 7 | Charging member 3 | 600 | 0.26 | 13.0 | 0.17 | 2 | 1 | 2 | #2800 |

TABLE 10-continued

| | | | | | | | | | |
|---|---|---|---|---|---|---|---|---|---|
| Example 8 | Charging member 4 | 600 | 4.23 | 70.5 | 6.10 | 2 | 1 | 2 | #2800 |
| Example 9 | Charging member 5 | 600 | 2.2 | 100.0 | 2.23 | 2 | 1 | — | — |
| Example 10 | Charging member 6 | 600 | 4.93 | 49.3 | 5.60 | 1 | 1 | 2 | #2800 |
| Example 11 | Charging member 1 | 400 | 0.22 | 11.0 | 0.21 | 1 | 1 | 2 | #2800 |
| Example 12 | Charging member 1 | 900 | 0.22 | 11.0 | 0.21 | 1 | 1 | 2 | #2800 |
| Example 13 | Charging member 1 | 600 | 0.22 | 11.0 | 0.21 | 3 | 2 | 2 | #2800 |
| Example 14 | Charging member 1 | 600 | 0.22 | 11.0 | 0.21 | 4 | 3 | 2 | #2800 |
| Comparative Example 1 | Charging member 1 | 600 | 0.22 | 11.0 | 0.21 | 3 | 1 | 1 | #4000 |
| Comparative Example 2 | Charging member 1 | 600 | 0.22 | 11.0 | 0.21 | 3 | 1 | 2 | #2800 |
| Comparative Example 3 | Charging member 1 | 600 | 0.22 | 27.5 | 0.21 | 3 | 1 | 3 | #3000 |
| Comparative Example 4 | Charging member 1 | 600 | 0.22 | 1.8 | 0.21 | 3 | 1 | 2 | #2800 |
| Comparative Example 5 | Charging member 7 | 600 | 0.09 | 4.5 | 0.20 | 1 | 1 | 2 | #2800 |
| Comparative Example 6 | Charging member 8 | 600 | 6.8 | 68.0 | 5.65 | 1 | 1 | 2 | #2800 |
| Comparative Example 7 | Charging member 9 | 600 | 2.01 | 154.6 | 2.22 | 1 | 1 | 1 | #4000 |
| Comparative Example 8 | Charging member 10 | 600 | 1.32 | 66.0 | 1.25 | 1 | 1 | 2 | #2800 |

| Example | Polishing time (sec) | Rvk (μm) | Sm (μm) | Mr2 (%) | Pattern memory | ΔV (V) |
|---|---|---|---|---|---|---|
| Example 1 | 10 | 0.020 | 20 | 75 | A | 13 |
| Example 2 | 6 | 0.020 | 20 | 85 | A | 12 |
| Example 3 | 15 | 0.050 | 18 | 85 | A | 15 |
| Example 4 | 20 | 0.062 | 16 | 85 | A | 12 |
| Example 5 | 8 | 0.020 | 8 | 85 | A | 14 |
| Example 6 | 2 | 0.011 | 42 | 85 | A | 14 |
| Example 7 | 3 | 0.020 | 15 | 85 | A | 13 |
| Example 8 | 15 | 0.060 | 14 | 85 | A | 13 |
| Example 9 | — | 0.022 | 20 | 80 | A | 15 |
| Example 10 | 28 | 0.100 | 15 | 80 | A | 14 |
| Example 11 | 3 | 0.020 | 20 | 80 | B | 14 |
| Example 12 | 3 | 0.020 | 20 | 80 | B | 14 |
| Example 13 | 3 | 0.020 | 20 | 80 | A | 14 |
| Example 14 | 1 | 0.020 | 20 | 80 | A | 14 |
| Comparative Example 1 | 10 | 0.020 | 20 | 73 | E | 30 |
| Comparative Example 2 | 3 | 0.020 | 20 | 88 | E | 30 |
| Comparative Example 3 | 1 | 0.008 | 40 | 85 | E | 25 |
| Comparative Example 4 | 40 | 0.120 | 10 | 85 | E | 27 |
| Comparative Example 5 | 3 | 0.020 | 20 | 85 | E | 25 |
| Comparative Example 6 | 28 | 0.100 | 10 | 85 | E | 27 |
| Comparative Example 7 | 3 | 0.013 | 38 | 85 | E | 27 |
| Comparative Example 8 | 3 | 0.020 | 20 | 80 | E | 35 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191569, filed Oct. 18, 2019, which is hereby incorporated by reference herein in its entirety.

What is claimed is:

1. A process cartridge detachably attachable to a main body of an electrophotographic apparatus, the process cartridge comprising an electrophotographic photosensitive member and a charging member, wherein the charging member includes a support having a conductive outer surface and a conductive layer provided on the outer surface of the support, the conductive layer has a matrix containing a first rubber and a plurality of domains dispersed in the matrix, the domain contains a second rubber and an electronic conductive agent, at least a part of domains is exposed to the outer surface of the charging member, the outer surface of the charging member is composed of at least the matrix and at least a part of domains, when a volume resistivity of the matrix is defined as Rcm and a volume resistivity of the domain is defined as Rcd, Rcm is $1.0\times10^5$ times or more of Rcd, an average value Sd of circle equivalent diameters of the domains observed on the outer surface of the charging member is 0.1 μm or more and 5.0 μm or less, the electrophotographic photosensitive member contains a support, a photosensitive layer, and a protective layer in this order, the protective layer contains a polymer of a composition containing a compound having a polymerizable group, and when a surface roughness of the protective layer is measured, a protruding valley portion Rvk is 0.01 μm or more and 0.10 μm or less and a load length ratio Mr2 is 75% or more and 85% or less, and Sd/Rvk is 1 or more and 100 or less.

2. The process cartridge according to claim 1, wherein an average interval Sm of irregularities of the protective layer of the electrophotographic photosensitive member is 10 μm or more and 40 μm or less.

3. The process cartridge according to claim 1, wherein Sd/Rvk is 5 or more and 80 or less.

4. The process cartridge according to claim 1, wherein an average value Dms of distances between wall surfaces of the domain and an adjacent domain observed on the outer surface of the charging member is 0.2 μm or more and 6 μm or less.

5. The process cartridge according to claim 1, wherein the protective layer contains at least a polymer of a composition containing a compound having a triarylamine structure.

6. The process cartridge according to claim 1, wherein a contact width between the electrophotographic photosensitive member and the charging member is 500 μm or more and 800 μm or less.

7. An electrophotographic apparatus comprising an electrophotographic photosensitive member and a charging member, wherein the charging member includes a support having a conductive outer surface and a conductive layer provided on the outer surface of the support, the conductive layer has a matrix containing a first rubber and a plurality of domains dispersed in the matrix, the domain contains a second rubber and an electronic conductive agent, at least a part of domains is exposed to the outer surface of the charging member, the outer surface of the charging member is composed of at least the matrix and at least a part of domains, when a volume resistivity of the matrix is defined as Rcm and a volume resistivity of the domain is defined as Rcd, Rcm is $1.0\times10^5$ times or more of Rcd, an average value Sd of circle equivalent diameters of the domains observed on the outer surface of the charging member is 0.1 μm or more and 5.0 μm or less, the electrophotographic photosensitive member contains a support, a photosensitive layer, and a protective layer in this order, the protective layer contains a polymer of a composition containing a compound having a polymerizable group, and when a surface roughness of the protective layer is measured, a protruding valley portion Rvk is 0.01 μm or more and 0.10 μm or less and a load length ratio Mr2 is 75% or more and 85% or less, and Sd/Rvk is 1 or more and 100 or less.

8. The electrophotographic apparatus according to claim 7, wherein an average interval Sm of irregularities of the protective layer of the electrophotographic photosensitive member is 10 μm or more and 40 μm or less.

9. The electrophotographic apparatus according to claim 7, wherein Sd/Rvk is 5 or more and 80 or less.

10. The electrophotographic apparatus according to claim 7, wherein an average value Dms of distances between wall surfaces of the domain and an adjacent domain observed on the outer surface of the charging member is 0.2 μm or more and 6 μm or less.

11. The electrophotographic apparatus according to claim 7, wherein the protective layer contains at least a polymer of a composition containing a compound having a triarylamine structure.

12. The electrophotographic apparatus according to claim 7, wherein a contact width between the electrophotographic photosensitive member and the charging member is 500 μm or more and 800 μm or less.

* * * * *